US010344945B2

(12) United States Patent
Hoch et al.

(10) Patent No.: US 10,344,945 B2
(45) Date of Patent: Jul. 9, 2019

(54) LUMINAIRE WITH PRE-ASSEMBLED LIGHT ENGINE AND LENS

(71) Applicant: ABL IP Holding LLC, Decatur, GA (US)

(72) Inventors: Matthew Scott Hoch, Newark, OH (US); Michael Ray Miller, Conyers, GA (US); Mark C. Logan, Atlanta, GA (US)

(73) Assignee: ABL IP Holding LLC, Atlanta, GA (US)

( * ) Notice: Subject to any disclaimer, the term of this patent is extended or adjusted under 35 U.S.C. 154(b) by 77 days.

(21) Appl. No.: 15/145,004

(22) Filed: May 3, 2016

(65) Prior Publication Data

US 2016/0327237 A1 Nov. 10, 2016

Related U.S. Application Data

(60) Provisional application No. 62/158,133, filed on May 7, 2015.

(51) Int. Cl.
*F21S 8/00* (2006.01)
*F21V 5/04* (2006.01)
(Continued)

(52) U.S. Cl.
CPC ..... *F21V 5/04* (2013.01); *F21S 8/00* (2013.01); *F21V 17/164* (2013.01); *F21V 23/009* (2013.01); *F21V 31/005* (2013.01); *F21S 8/061* (2013.01); *F21V 15/01* (2013.01); *F21V 17/101* (2013.01); *F21Y 2103/10* (2016.08); *F21Y 2113/00* (2013.01); *F21Y 2115/10* (2016.08)

(58) Field of Classification Search
CPC ..... F21S 8/00; F21S 8/061; F21V 15/01; F21V 17/101; F21V 17/164; F21V 23/009; F21V 31/005; F21V 5/04; F21Y 2103/10; F21Y 2113/00; F21Y 2115/10
USPC ..... 362/217.02, 217.1, 217.11, 217.12, 362/217.13, 217.14, 217.15, 217.17, 362/217.16
See application file for complete search history.

(56) References Cited

U.S. PATENT DOCUMENTS 6,536,924 B2 * 3/2003 Segretto ..... F21S 2/005 362/247
6,979,097 B2 12/2005 Elam et al.
(Continued)

FOREIGN PATENT DOCUMENTS

WO 2010027923 3/2010
WO 2014133987 9/2014

OTHER PUBLICATIONS

Beghelli, "Illumina BS100 LED," www.beghelliusa.com, pp. 125-126, 2 pages (believed to be available as early as May 3, 2016).
(Continued)

*Primary Examiner* — Tsion Tumebo
(74) *Attorney, Agent, or Firm* — Kilpatrick Townsend & Stockton LLP

(57) ABSTRACT

A luminaire includes a housing and a light engine. The light engine is detachably secured to the housing and includes a lens and an optical tray. The lens has a top surface, a bottom surface, and a peripheral edge. The top surface of the lens define a lens cavity. The optical tray is supported by the lens within the lens cavity.

20 Claims, 31 Drawing Sheets

(51) Int. Cl.

| | |
|---|---|
| ***F21V 15/01*** | (2006.01) |
| ***F21V 17/10*** | (2006.01) |
| ***F21V 17/16*** | (2006.01) |
| ***F21V 23/00*** | (2015.01) |
| ***F21Y 103/10*** | (2016.01) |
| ***F21Y 113/00*** | (2016.01) |
| ***F21Y 115/10*** | (2016.01) |
| ***F21V 31/00*** | (2006.01) |
| *F21S 8/06* | (2006.01) |

(56) References Cited

U.S. PATENT DOCUMENTS

| | | | | |
|---|---|---|---|---|
| 9,228,700 | B2 * | 1/2016 | Westermarck | F21K 9/90 |
| 9,423,116 | B2 * | 8/2016 | Sieberth | F21V 23/06 |
| 2007/0274084 | A1 * | 11/2007 | Kan | F21V 5/002 362/373 |
| 2010/0135020 | A1 * | 6/2010 | Moore | A47F 11/10 362/249.02 |
| 2011/0090682 | A1 * | 4/2011 | Zheng | F21V 23/006 362/218 |
| 2011/0310604 | A1 * | 12/2011 | Shimizu | F21V 15/015 362/235 |
| 2013/0063934 | A1 * | 3/2013 | Vermeland | F21V 31/005 362/217.05 |
| 2013/0272000 | A1 * | 10/2013 | Pearson | F21S 2/005 362/362 |
| 2014/0009926 | A1 * | 1/2014 | Simon | F21V 17/12 362/222 |
| 2015/0003070 | A1 * | 1/2015 | Medendorp, Jr. | F21K 9/17 362/294 |
| 2015/0016100 | A1 * | 1/2015 | Ishii | F21S 8/043 362/223 |
| 2015/0167902 | A1 * | 6/2015 | Rodgers | F21S 8/03 362/221 |

OTHER PUBLICATIONS

Cooper Lighting, "VRVT2 2', 4' and 8' Lengths," Fail-Safe, T8 Biaxial Fluorescent Vandal Resistant, Dec. 3, 2013, 2 pages.

Columbia Lighting, "Enclosed and Gasketed Fiberglass Extreme Environment / LED," Columbia Lighting, www.columbialighting.com, Oct. 2, 2014, 3 pages.

SLP Lighting, "Integrate LEDs into the Citadel 2 Enclosure," Citadel 2™ LED Enclosure, 4 pages (believed to be available as early as May 3, 2016).

* cited by examiner

LUMINAIRE WITH PRE-ASSEMBLED LIGHT ENGINE AND LENS

REFERENCE TO RELATED APPLICATIONS

This application claims the benefit of U.S. Provisional Application Ser. No. 62/158,133, filed May 7, 2015 and entitled LIGHT ENGINES AND LIGHT FIXTURES INCORPORATING SAME, which is incorporated in its entirety by this reference.

BACKGROUND

Field

This application relates to luminaires, and more particularly, to luminaires with a pre-assembled light engine and lens.

Background Technology

Typical luminaires generally include an optical tray and LED boards that are mechanically attached to a housing of the luminaire. To install these luminaires, a lower lens of the luminaire is removed, the housing is mounted at a desired location, electrical connections to the luminaire are made, the optical tray is attached to the housing, and then the lower lens is attached to the housing. There is a need for luminaires that reduce the number of installation steps and thus facilitate ease of installation.

SUMMARY

Described herein is a luminaire and a method of assembling the luminaire. In one aspect, the luminaire can comprise a housing and a light engine. In some aspects, the light engine is detachably secured to the housing and comprises a lens and an optical tray.

In a further aspect, the method of assembling the luminaire comprises the steps of: (a) pre-assembling a light engine by detachably securing an optical tray to a lens; and (b) detachably securing the light engine to a housing.

Various implementations described in the present disclosure can include additional systems, methods, features, and advantages, which can not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following figures are illustrated to emphasize the general principles of the present disclosure. Corresponding features and components throughout the figures can be designated by matching reference characters for the sake of consistency and clarity.

DETAILED DESCRIPTION

Figure 1:
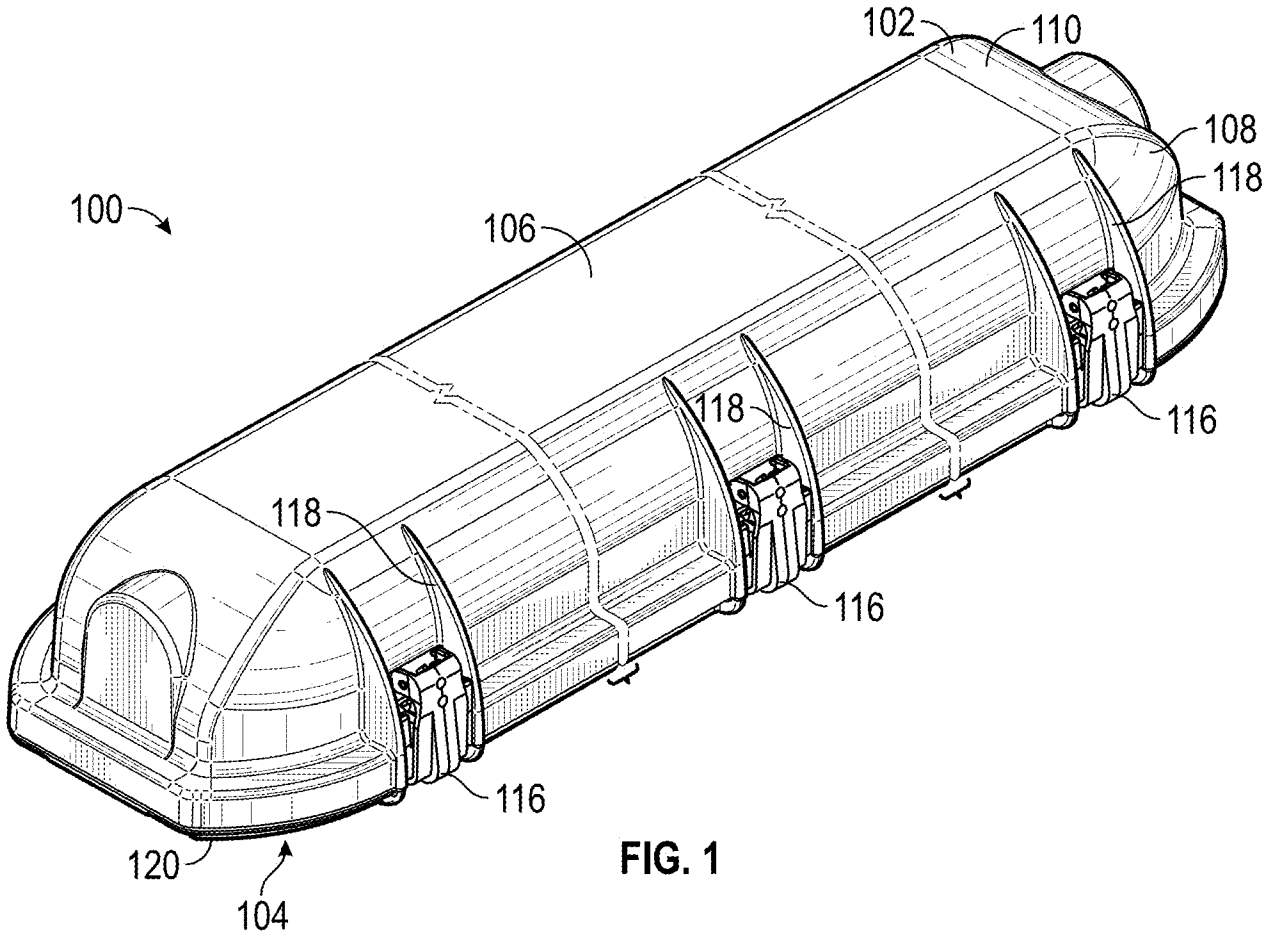
FIG. 1 is a perspective view of a luminaire having a housing and a light engine having an optical tray and lens according to an example of the current disclosure.

The present invention can be understood more readily by reference to the following detailed description, examples, drawings, and claims, and their previous and following description. However, before the present devices, systems, and/or methods are disclosed and described, it is to be understood that this invention is not limited to the specific devices, systems, and/or methods disclosed unless otherwise specified, and, as such, can, of course, vary. It is also to be understood that the terminology used herein is for the purpose of describing particular aspects only and is not intended to be limiting.

The following description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

As used throughout, the singular forms "a," "an" and "the" include plural referents unless the context clearly dictates otherwise. Thus, for example, reference to "a band" can include two or more such bands unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance can or can not occur, and that the description includes instances where said event or circumstance occurs and instances where it does not.

The word "or" as used herein means any one member of a particular list and also includes any combination of members of that list. Further, one should note that conditional language, such as, among others, "can," "could," "might," or "can," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily include logic for deciding, with or without user input or prompting, whether these features, elements and/or steps are included or are to be performed in any particular embodiment. Directional references such as "up," "down," "top," "left," "right," "front," "back," and "corners," among others are intended to refer to the orientation as illustrated and described in the figure (or figures) to which the components and directions are referencing.

Embodiments of the present invention relate to a light engine having an attached optical tray and lens, as well as to light fixtures or luminaires incorporating such light engines.

Referring to FIG. 1, in various examples, a luminaire 100 comprises a housing 102 and a light engine 104. It will be appreciated that the shape of the luminaire 100 should not be considered limiting on the current disclosure as various polygonal-shaped luminaire 100 can be present. For example and without limitation, the luminaire 100 can be a rounded-rectangular shape (FIGS. 1 and 7-15), rectilinear, trapezoidal (FIGS. 17A-E, 18A-B, 19A-B, and 23A-E), angular (FIG. 26A-E), round, saucer-like (FIGS. 21A-E and 24A-D), tubular (FIGS. 22A-E and 25A-D), or have any other desired shape.

It will further be appreciated that the luminaire 100 can be of any size and have a variety of different profiles and profile heights. As one non-limiting example, the luminaire 100 is approximately two feet long. In other examples, the luminaire 100 may be of any length. Embodiments of the luminaire 100 are may be more efficient than traditional luminaires. As a non-limiting example, the luminaire 100 according to one embodiment of the invention may be two feet long and emit 4000 lumens; traditionally, a four foot fluorescent fixture was required to achieve this output.

Figure 15:
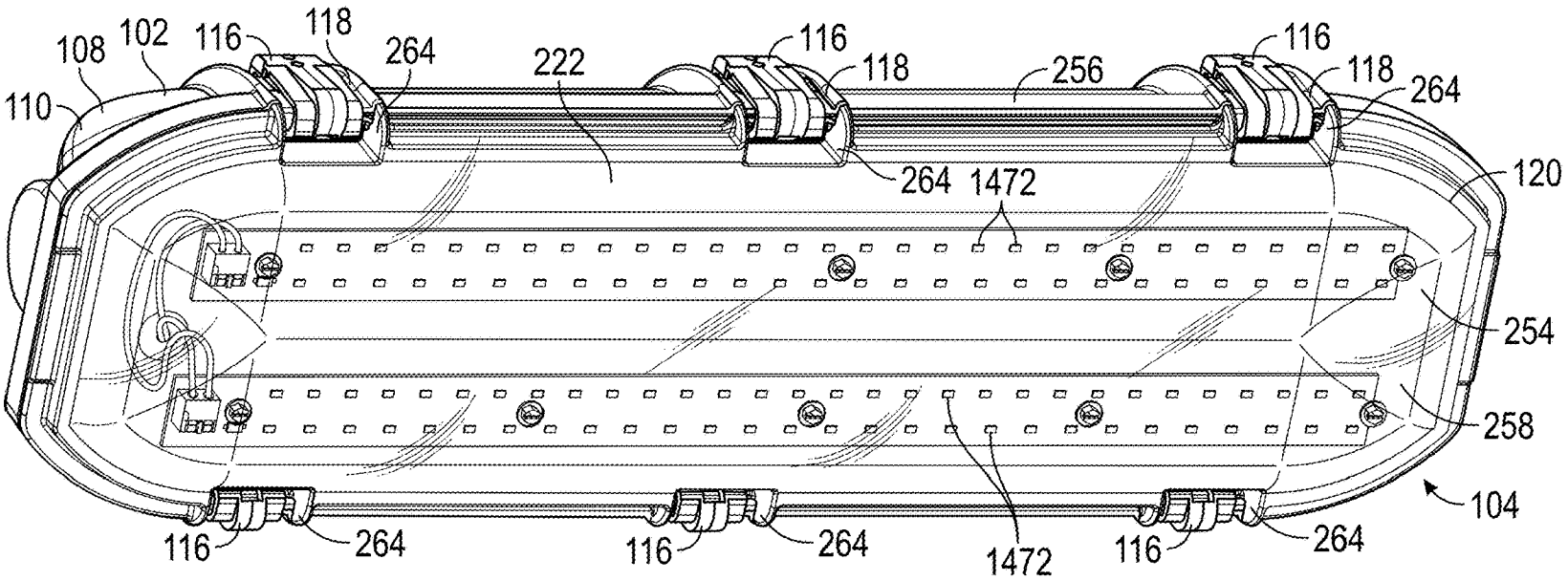
FIG. 15 is a bottom perspective view of the luminaire of FIG. 1.

The housing 102 comprises a base 106, a sidewall 108, an outer surface 110, and an inner surface 1512 (illustrated in FIG. 15). In various examples, as described in greater detail below, the inner surface 1512 defines a housing cavity 1514.

The housing 102 may be constructed from various materials as desired. As one non-limiting example, in some embodiments, the housing 102 may be formed from a material that is compliant with UL 94-5VA flammability ratings, such as, but not limited to, flame resistant polymeric materials, metal, or glass. As another non-limiting example, the housing 102 may be constructed from a UL F1 rated material. In some examples, metal (e.g. steel, aluminum, etc.) or glass can be utilized to construct the housing. In other examples, polymeric materials such as, but not limited to SMC fiberglass, BMC fiberglass, polycarbonate, acrylonitrile butadiene styrene (ABS), polycarbonate blends, etc. can be utilized to construct the housing 102. In these examples using polymeric materials, in some aspects, the housing 102 can be formed through a compression molding or injection molding process. It will appreciated that other manufacturing process can also be used to construct the housing 102, including, but not limited to, machining, stamping, various types of molding, etc.

In some examples, as illustrated in FIG. 1, housing fasteners 116 are optionally attached to the housing 102. The housing fasteners 116 can be utilized to aid in detachably securing the light engine 104 to the housing 102, as described in greater detail below.

In the illustrated embodiment, housing fasteners 116 are provided along the sidewall 108 of the housing 102. In some examples, the housing fasteners 116 can be formed as part of the housing 102 or may be attached to the housing 102. It will be appreciated that the number or location of the housing fasteners 116 should not be considered limiting on the current disclosure. In one embodiment, the housing fasteners 116 are latches; however, in various other examples, the housing fasteners 116 can be any suitable mechanism suitable for detachably securing the light engine 104 to the housing 102, including, but not limited to, clips, clasps, hooks, snaps, pins, nuts and bolts, and various other fasteners. For example, in some embodiments, the housing fastener 116 can be latches (FIGS. 1, 7-15, and 23A-E), snaps (FIGS. 20A-C and 21A-E), a gasket band (FIGS. 24A-E), or metal clips (FIGS. 22A-E), which may be used to secure the connection between the housing 102 and the light engine 104.

Figure 2:
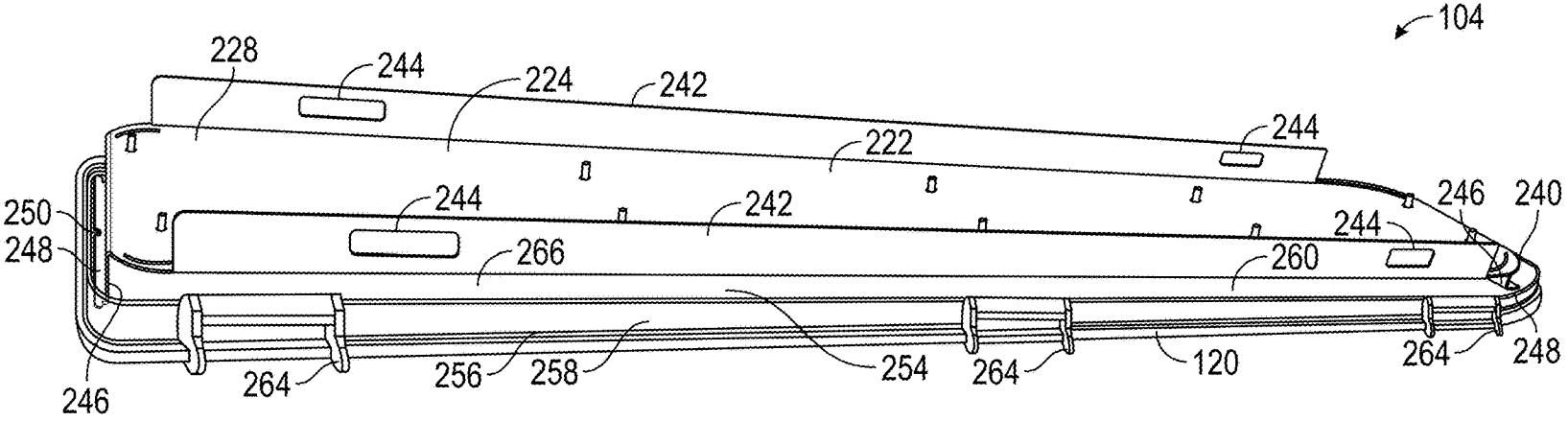
FIG. 2 is a perspective view of the light engine of FIG. 1.

The light engine 104 includes the lens 120 and an optical tray 222 (illustrated in FIG. 2). In various examples, the optical tray 222 is attached to the housing 102 via the lens 120, as described in greater detail below.

Figure 3:
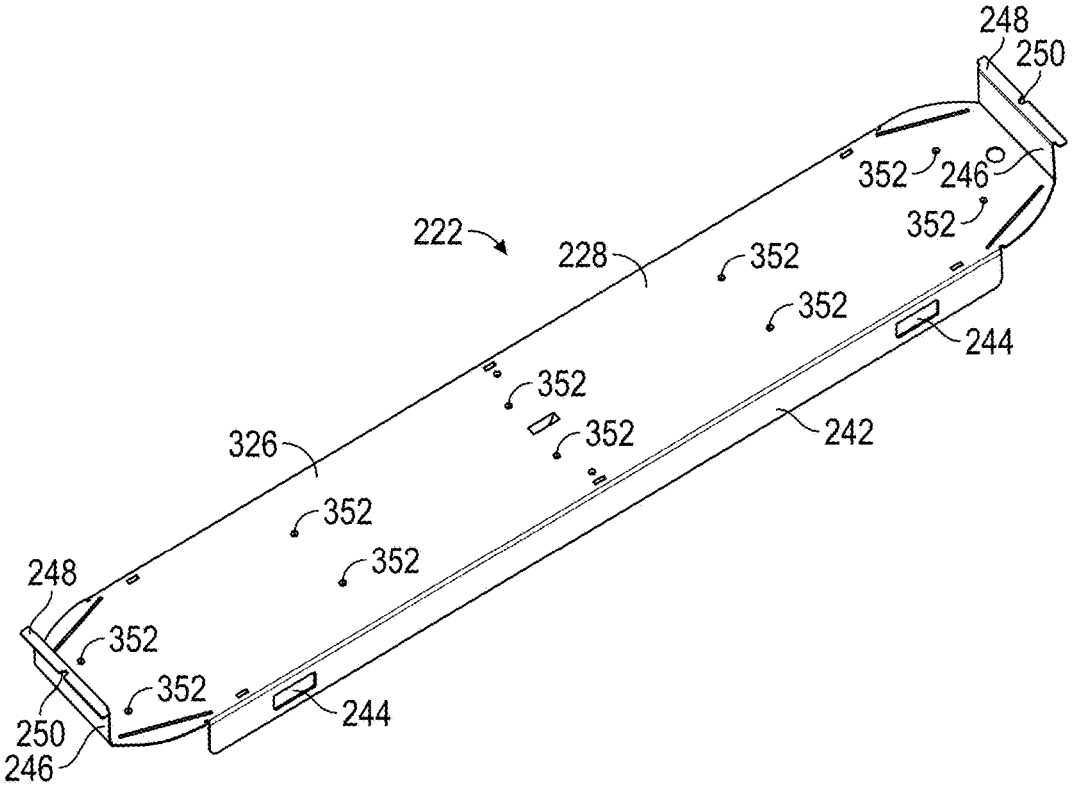
FIG. 3 is a top perspective view of the optical tray of the light engine of FIG. 1.
Figure 4:
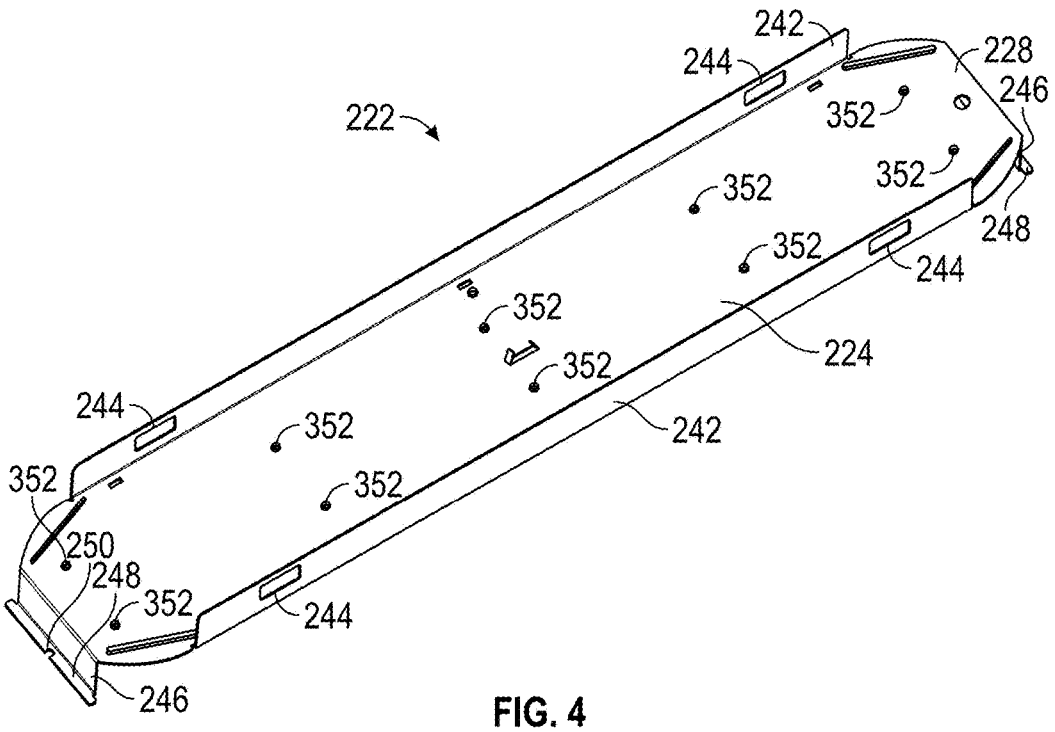
FIG. 4 is a bottom perspective view of the optical tray of the light engine of FIG. 1.
Figure 14:
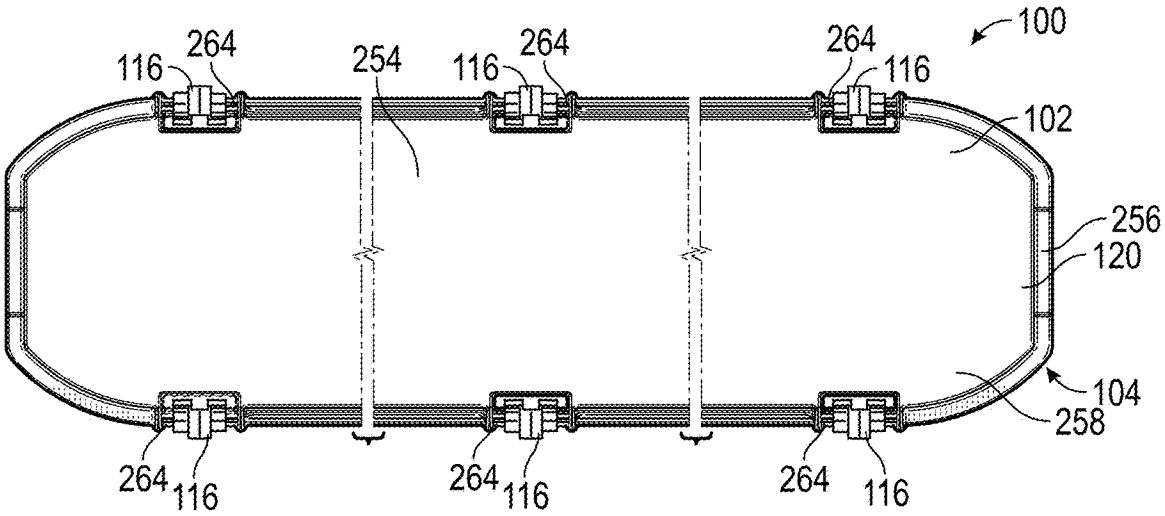
FIG. 14 is a bottom view of the luminaire of FIG. 1.

Referring to FIGS. 2-4, the optical tray 222 of the light engine 104 includes a mounting support 228 having a top surface 224, a bottom surface 326, and a perimeter edge 240. Light sources may be provided on the bottom surface 326 of the optical tray 222 so that light emitted from the light sources is directed through the lens 120. As illustrated in FIG. 14, in various examples, light emitting diodes ("LEDs") 1472 are provided on the mounting support 228 of the optical tray 222. In some examples, the LEDs 1472 can be mounted via PCBs or can be provided using chip on board technology. In other examples, the LEDs 1472 may be provided on a separate mounting substrate that is coupled to the optical tray 222 (such as to the mounting support 228). In some examples, this separate mounting substrate can be bent or otherwise formed so that each LED 1472 mounted to it has an optical axis that is not oriented orthogonal to the optical tray 222. In these examples, the LEDs 1472 are tilted within the light engine 104 so that the directionality of their light is not straight down. Moreover, in further examples, reflectors (not shown) may be mounted to the undersurface of the mounting support 228 to help achieve a desired light pattern and emission. It will be appreciated that any number and any type of LEDs 1472 (as well as other light sources) may be used with the light engine 104.

The mounting support 228 may be made from any suitable metallic or polymeric material, but in some embodiments it is formed from a thermally conductive material so as to help dissipate the heat generated by the LEDs. For example, in some embodiments the mounting support 228 is formed from metal, such as aluminum or steel. In various examples, the mounting support 228 defines a plurality of bores 352 extending from the top surface 224 to the bottom surface 326 that can be utilized for securing various devices or structures to the mounting support 228.

The mounting support 228 may include flanges about the perimeter edge 240 for attachment to the lens 120 as well as the housing 102 (as discussed below). In one embodiment, at least one upstanding flange 242 is provided along at least a portion of the perimeter edge 240. The at least one upstanding flange 242 extends in an upward direction relative to the top surface 224. In some examples, the at least one upstanding flange 242 is substantially perpendicular to the top surface 224, although in other embodiments, the at least one upstanding flange 242 can be at various other angles relative to the top surface 224. In various embodiments, the at least one upstanding flange 242 defines at least one slot 244. In some examples, the at least one upstanding flange 242 is formed integrally with the mounting support 228; however, in various other examples, the at least one upstanding flange may be attached to the mounting support 228 through various attachment mechanisms.

In the present example, the mounting support 228 includes two upstanding flanges 242, although it will be appreciated that the number of upstanding flanges 242 should not be considered limiting on the current disclosure. In various examples with two upstanding flanges 242, the upstanding flanges 242 are at distal positions along the perimeter edge 240, although they need not be.

In some embodiments, the mounting support 228 optionally includes at least one downwardly extending flange 246 along at least a portion of the perimeter edge 240. In these examples, the at least one downwardly extending flange 246 extends in a downward direction relative to the bottom surface 326. In some examples, the at least one downwardly extending flange 246 is substantially perpendicular to the bottom surface 326, although in other embodiments, the at least one downwardly extending flange 246 can be at various other angles relative to the bottom surface 326. In some examples, the at least one downwardly extending flange 246 is formed integrally with the mounting support 228; however, in various other examples, the at least one downwardly extending flange 246 may be attached to the mounting support 228 through various attachment mechanisms.

In various examples, the at least one downwardly extending flange 246 includes a lip 248 extending outwardly from a bottom edge of the downwardly extending flange 246. In some examples, the lip 248 extends outwardly substantially perpendicular to the downwardly extending flange 246, although it need not in various other embodiments. In various cases, the a notch 250 is defined in a distal edge of the lip 248.

In the present example, the mounting support 228 includes two downwardly extending flanges 246, although it will be appreciated that the number of downwardly extending flanges 246 should not be considered limiting on the current disclosure. In various examples with two downwardly extending flanges 246, the downwardly extending flanges 246 are at distal positions along the perimeter edge 240. In these examples, the downwardly extending flanges 246 can be at positions between the upstanding flanges 242, although they need not be.

Figure 5:
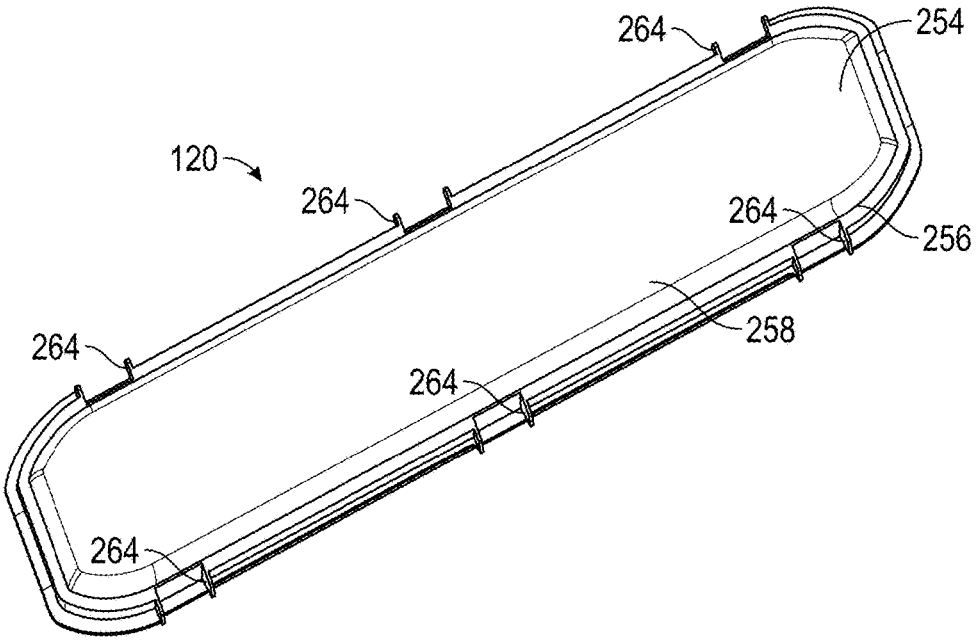
FIG. 5 is a top perspective view of the lens of the light engine of FIG. 1.
Figure 6:
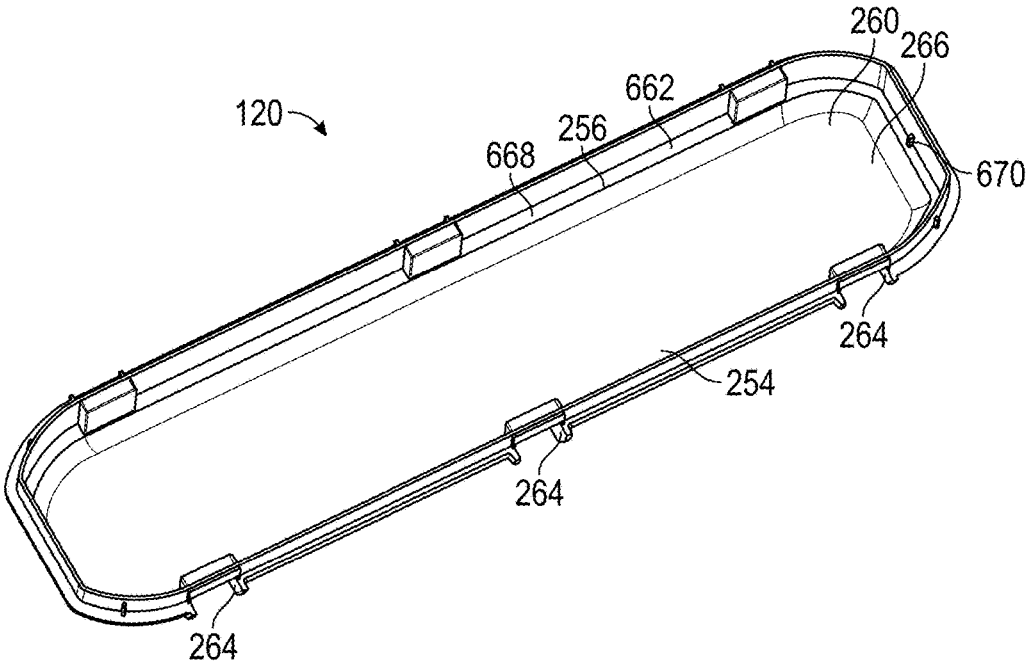
FIG. 6 is a bottom perspective view of the lens of the light engine of FIG. 1.
Figure 7:
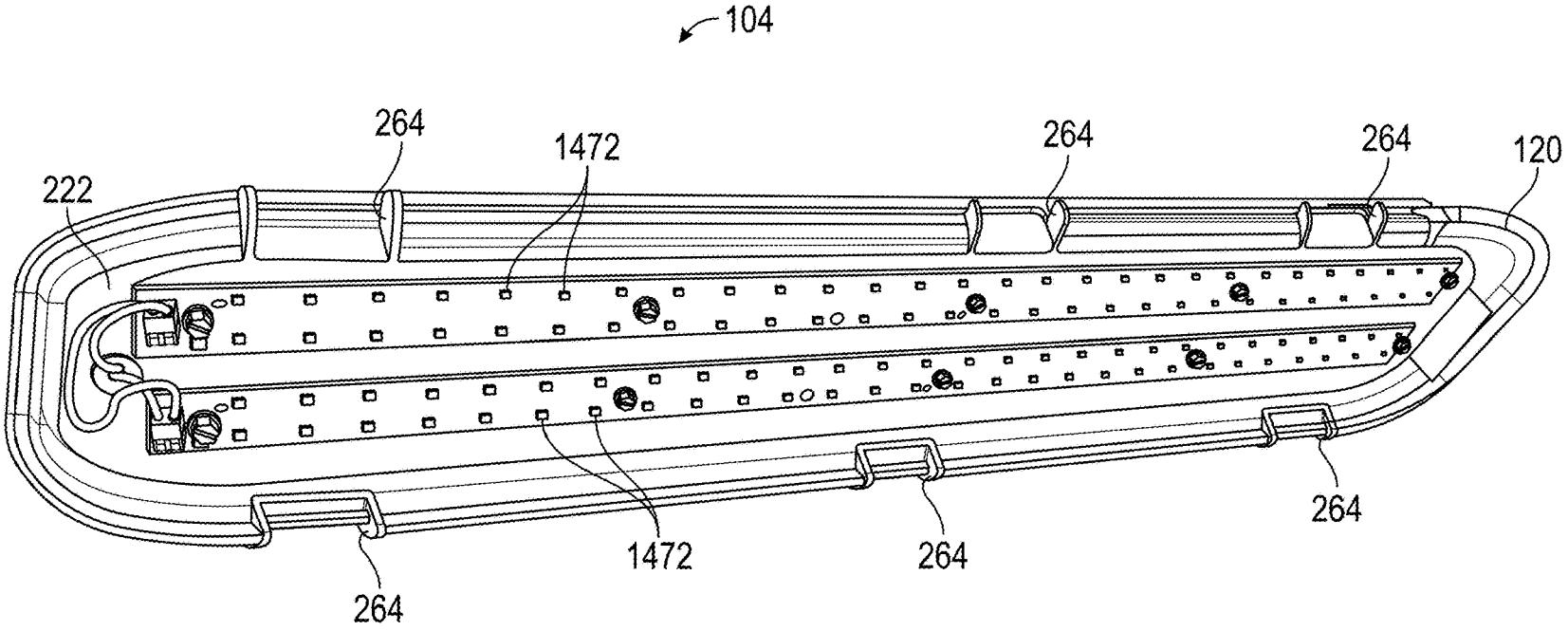
FIG. 7 is another perspective view of the light engine of FIG. 1.
Figure 8:
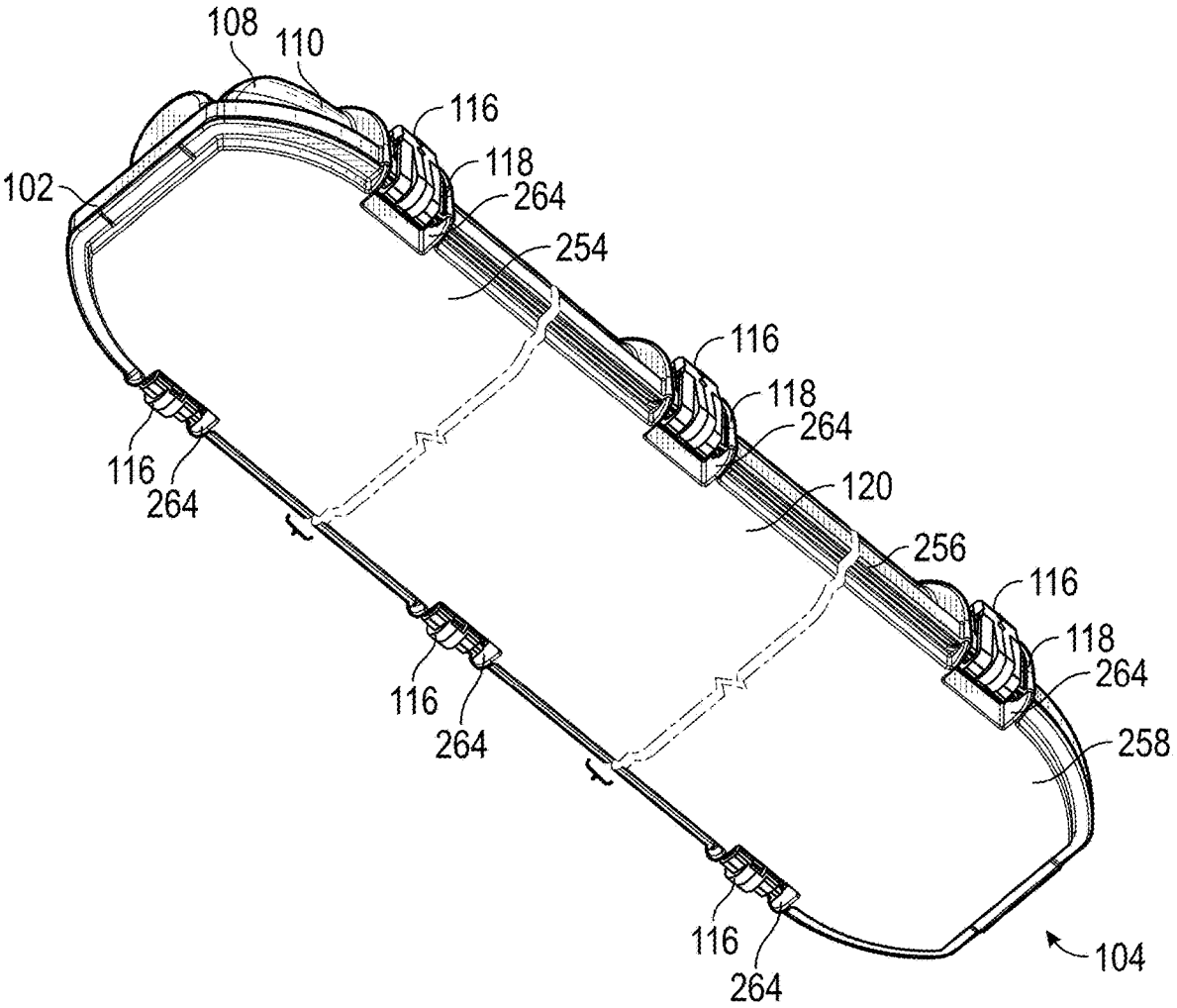
FIG. 8 is a bottom view of the luminaire of FIG. 1.
Figure 10:
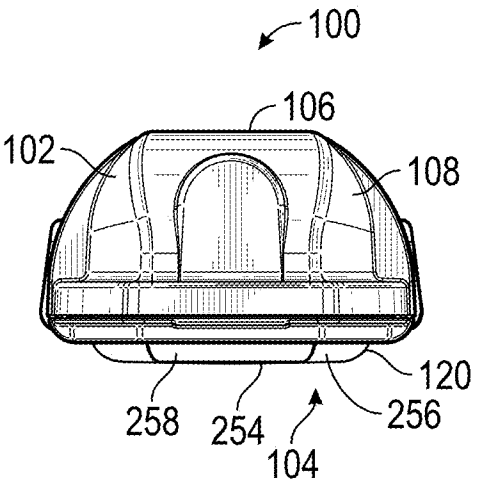
FIG. 10 is a back view of the luminaire of FIG. 1.
Figure 9:
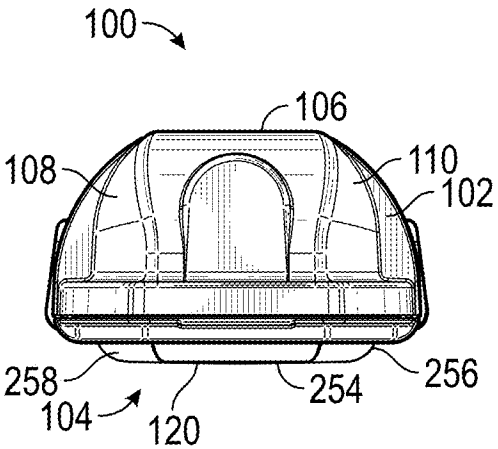
FIG. 9 is a front view of the luminaire of FIG. 1.
Figure 11:
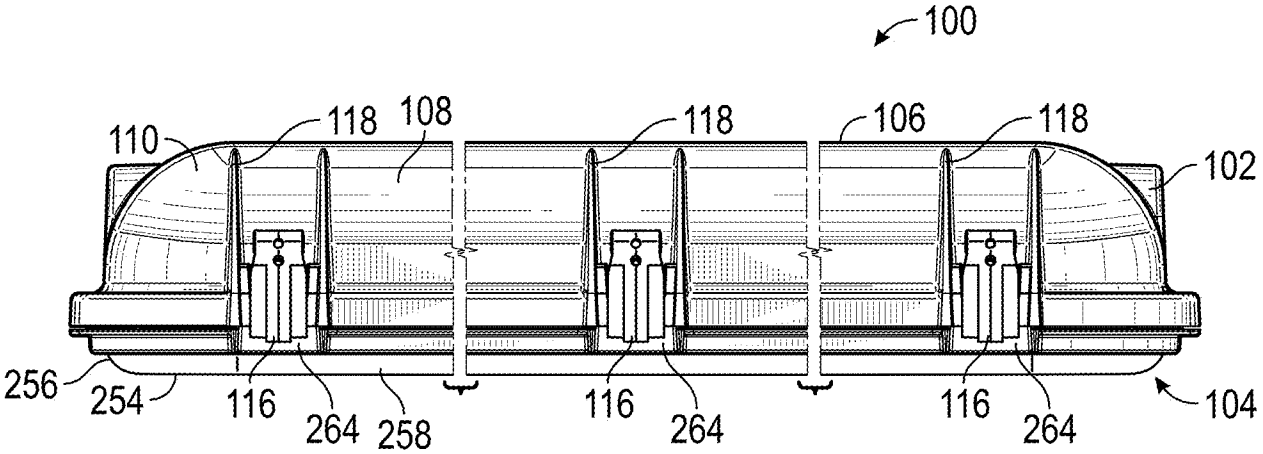
FIG. 11 is a side view of the luminaire of FIG. 1.
Figure 12:
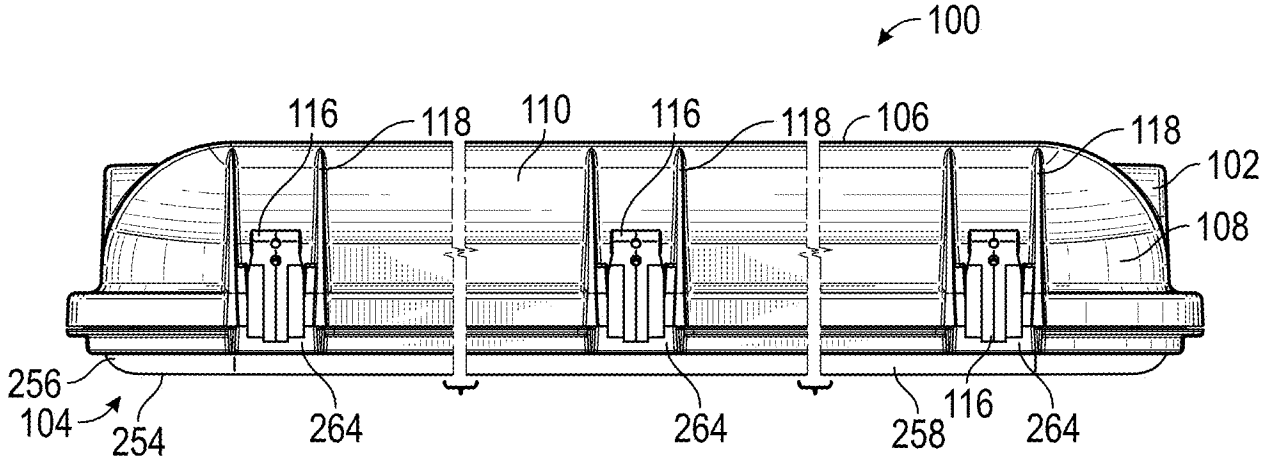
FIG. 12 is another side view of the luminaire of FIG. 1.
Figure 13:
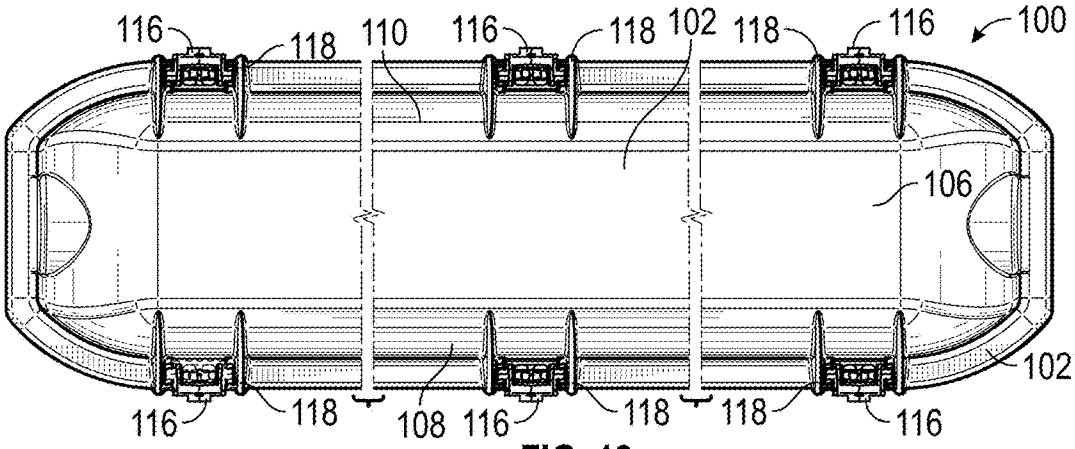
FIG. 13 is a top view of the luminaire of FIG. 1.

Referring to FIGS. 2, 5, and 6, the lens 120 of the light engine 104 includes a base 254, a sidewall 256, an outer surface 258, and an inner surface 260. The inner surface 260 of the base 254 defines a lens cavity 266. As illustrated in FIG. 2, the lens cavity 266 is dimensioned to at least partially receive the optical tray 222.

In some examples, securing recesses 264 are provided on the lens 120, such as along the sidewall 256 of the lens 120. The number of securing recesses 264 and their location should not be considered limiting on the current disclosure.

In some examples, the securing recesses 264 are partially defined by the base 254, although they need not be. In one non-limiting example and as described in more detail below, securing recesses 264 on the lens 120 engage with housing fasteners 116 on the housing 102 such that the lens 120 is detachably secured to the housing 102. In such case, the recesses 264 and fasteners 116 should be located on the lens 120 and housing 102, respectively, to allow such engagement.

In some examples, a ledge 662 having a ledge surface 668 extends from the inner surface of the sidewall 256 and into the lens cavity 266. The ledge 662 extends at least partially around the sidewall 256 within the lens cavity 266. In various examples, at least one tab 670 may be provided along the ledge 662. The number of tabs 670 should not be considered limiting on the current disclosure. In various examples with two tabs 670, the tabs 670 can be provided at distal locations on the ledge 662.

The lens 120 may be formed from any suitable material including, but not limited to acrylic, polycarbonate, silicone, and various other materials. Optionally, the lens 120 can include various optical enhancements including, but not limited to, ribbing, prisms, frosted appearance, and various other optical enhancements to achieve the desired light distribution and effect from the luminaire 100.

The light engine 104 is assembled with the optical tray 222 seated within the lens cavity 266. In various examples, the optical tray 222 is seated to rest at least partially on the ledge 662 of the lens 120 such that the lens 120 supports the optical tray 222. In embodiments where the optical tray 222 includes the at least one downwardly extending flange 246 having the lip 248, the underside of the lip 248 can be positioned to rest on the ledge 662. In some examples, the at least one downwardly extending flange 246 is positioned such that the at least one tab 670 engages the notch 250 of the lip 248. Engagement of the tab 670 in the notch 250, while optional, can help ensure proper positioning and registration of the optical tray 222 and lens 120, as well as prevent relative lateral and/or longitudinal translation between the optical tray 222 and lens 120.

The at least one downwardly extending flange 246 serves to distance the optical tray 222 from the base 254 of the lens 120 so as to ensure that the optical tray 222 is recessed to the desired degree within the lens cavity 262. For example and without limitation, the height of the at least one downwardly extending flange 246 may be tailored to achieve the desired recession depth. However, in various other embodiments where the at least one downwardly extending flange 246 is omitted, the bottom surface 326 of the optical tray 222 can rest directly on the ledge 662. It will be appreciated that various other configurations of tabs 670, flanges 242 and 246, lips 248, and notches 250 can also be present.

In various examples, the optical tray 222 is attached to the lens 120 to form the light engine 104. The optical tray 222 can be attached to the lens 120 through various attachment mechanisms including, but not limited to, mechanical fasteners, glues, adhesives, and various other attachment mechanisms. In one embodiment, the optical tray 222 is attached to the lens 120 through an adhesive tape. As a non-limiting example, double-sided tape, such as that sold under the trade name VHB™ by 3M™, is positioned on the underside of the optical tray 222 (for example, on the underside of the lip 248 that is positioned on the ledge 662 or on the bottom surface 326 of the mounting support 228) and engages the ledge 662 to secure the optical tray 222 and lens 120 together. In some cases with the adhesive tape, the adhesive tape selected can be tailored to meet the material surface requirements of the optical tray 222 and lens 120 as well as meet temperature ratings of the intended application of the luminaire 100. Once the light engine 104 is assembled, it is ready for incorporation into the housing 102 so as to form the luminaire 100.

Regardless of the type of luminaire 100, attachment of the optical tray 222 and lens 120 to each other facilitates installation and servicing of the luminaire 100. In traditional luminaires, the optical tray (with LEDs) and the lens historically have been separately attached to the housing. To install these traditional luminaires, the lens and optical tray were separately removed, the housing mounted, electrical connections were made, and then the optical tray and lens were separately re-attached. The luminaire 100 described above eliminates steps in this process by connecting the optical tray 222 and lens 120 to form the light engine 104 that can be removed and re-installed as a single unit. Moreover, the light engine 104 may be easily removed from the housing 102 for servicing, maintenance, and replacement. In some embodiments, a lanyard or tether may be provided between the housing 102 and the light engine 104. In such embodiments, the light engine 104 may not completely detach from the housing 102 during installation and servicing, but rather remains connected via the lanyard or tether.

FIGS. 7-15 illustrated the assembled luminaire 100. As illustrated, the housing fasteners 116 are utilized to detachably secure the light engine 104 to the housing 102. In the illustrated embodiment, housing fasteners 116 are latches provided on the housing 102 and the hook of each latch engages a securing recesses 264 provided on the lens 120. However, as explained above, myriad other structures for engaging the light engine 104 with the housing 102 are contemplated. Moreover, location of the fasteners 116 and recesses 264 could be reversed in that the fasteners 116 could be provided on the light engine 104 and the recesses 264 could be provided on the housing 102.

Figure 16:
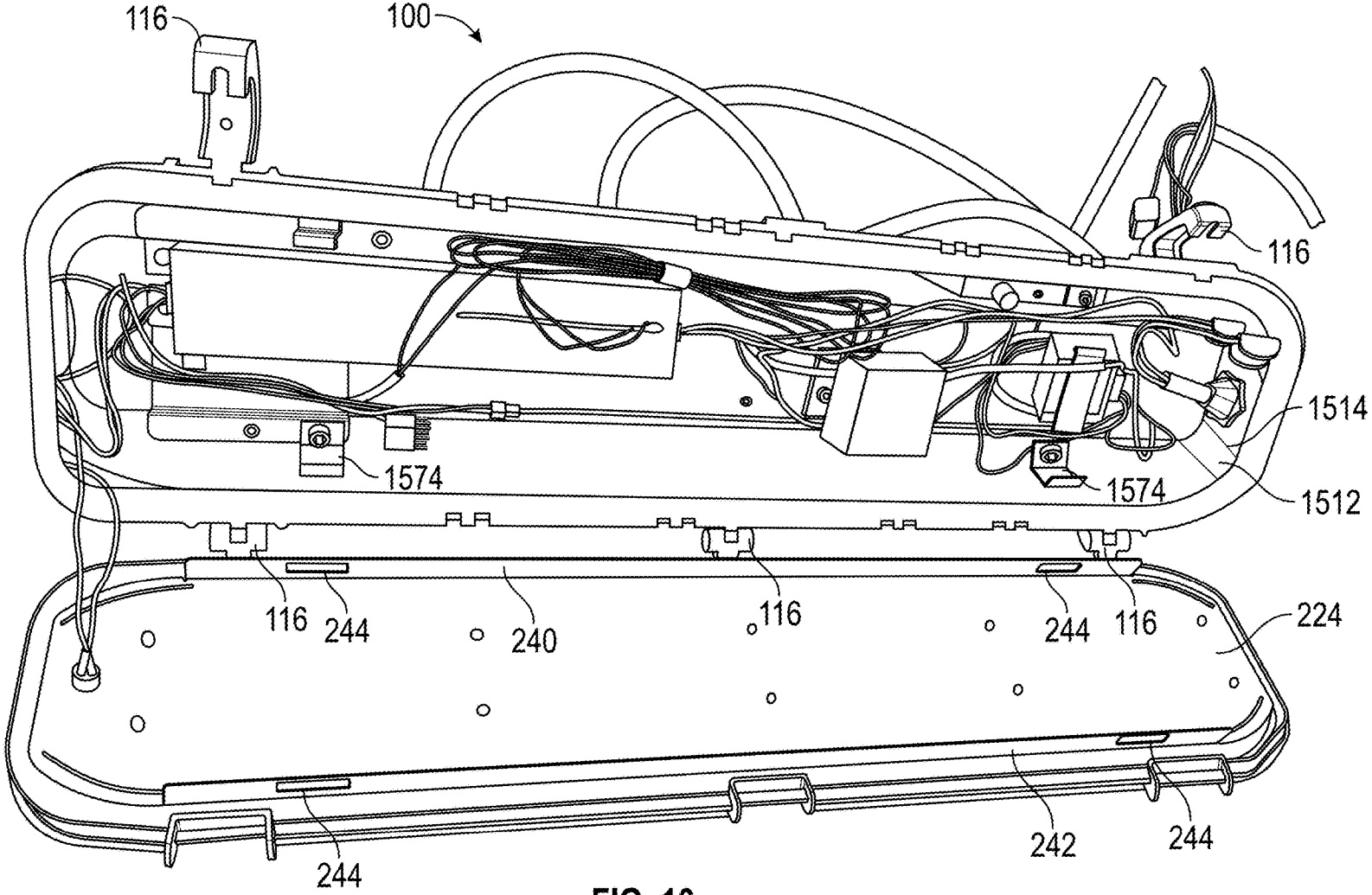
FIG. 16 is a perspective view of the luminaire of FIG. 1 with the light engine in a partially detached configuration.

Referring to FIG. 16, various electrical components (such as the LED driver, controls devices, transformers, MOV devices, fusing, etc.) can be mounted directly or indirectly to the housing 102 either within the housing cavity 1514 or exterior to the housing cavity 1514. For example and without limitation, in some embodiments, the electronics can be provided on an electrical tray that is mounted to the housing 102 via fasteners such as screws, clips, spring clips, bolts, hooks, and various other suitable types of fasteners. In these examples, the fasteners may be formed directly in, or attached directly to, the housing 102 or may be provided on the electrical tray mounted to the housing 102. As another non-limiting example, the electronics can be mounted directly on the housing 102 without the need for the electrical tray.

In other examples, electrical components may be mounted on the mounting support 228. For example, electrical components can be mounted on the top surface 224 or the bottom surface 326 of the mounting support 228. In some embodiments, the electrical components are mounted to the housing 102 and reside between the mounting support 228 and the housing 102 so as to thermally isolate the LEDs 1472 and the LED driver.

In various embodiments, the luminaire 100 includes interior fasteners 1574. The interior fasteners 1574 can be positioned within the housing cavity 1514. In various examples, the interior fasteners 1574 are formed integrally with the housing 102; however, in various other examples, the interior fasteners 1574 may be attached to the housing 102 through various attachment mechanisms. It will be appreciated that the number of interior fasteners 1574 or the location of the interior fasteners 1574 should not be considered limiting on the current disclosure. In the present example, the interior fasteners 1574 are spring clips; however, it will be appreciated that the interior fasteners 1574 can be screws, clips, spring clips, bolts, hooks, and various other suitable types of fasteners.

In some examples with interior fasteners 1574, the light engine 104 is positioned within the housing cavity 1514 such that the interior fasteners 1574 align with and engage the slots 244 in the upstanding flanges 242 of the mounting support 228 such that the light engine 104 effectively snap-fits into the housing 102. In these examples, the light engine 104 can be detachably secured to the housing 102 in addition to or in place of the housing fasteners 116.

A gasket or other sealing device may be interposed between the light engine 104 and the housing 102 to seal the inside of the luminaire 100 from dust, water, and other contaminants that can detrimentally impact its operation. The latches or other fastening structures disclosed herein—if used to secure the connection between the housing 102 and the light engine 104—can serve to compress the gasket so as to create a better seal.

While the light engine 104 is described and illustrated for use in a surface mounted or suspended luminaire 100, it can be used in other types of fixtures, including, but not limited to, wall-mounted luminaires 100. The light engine 104 may be provided in new luminaire housings or retrofitted into existing luminaire housings already installed in the field.

Figure 17A:
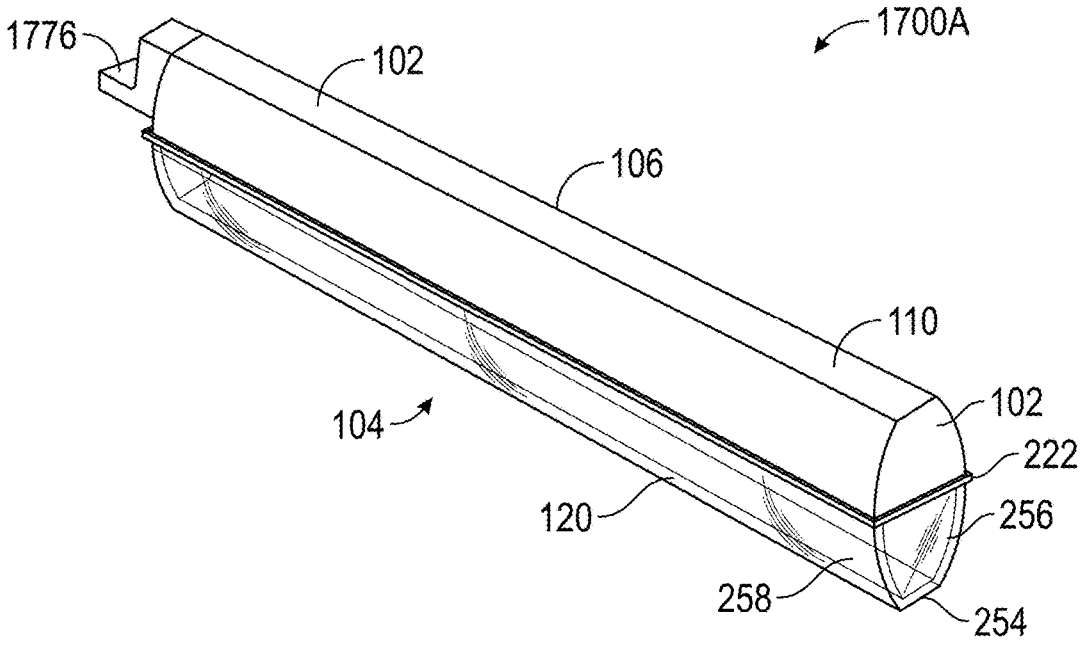
FIG. 17A is a perspective view of a luminaire according to an example of the current disclosure.
Figure 17B:
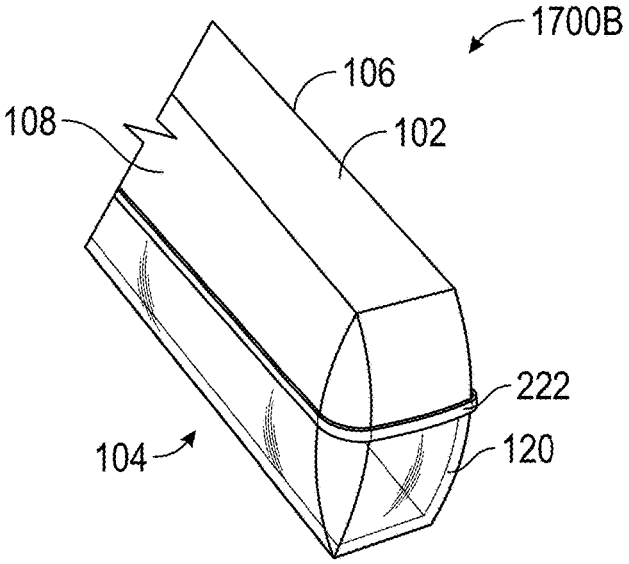
FIG. 17B is a side view of a luminaire according to an example of the current disclosure.
Figure 17C:
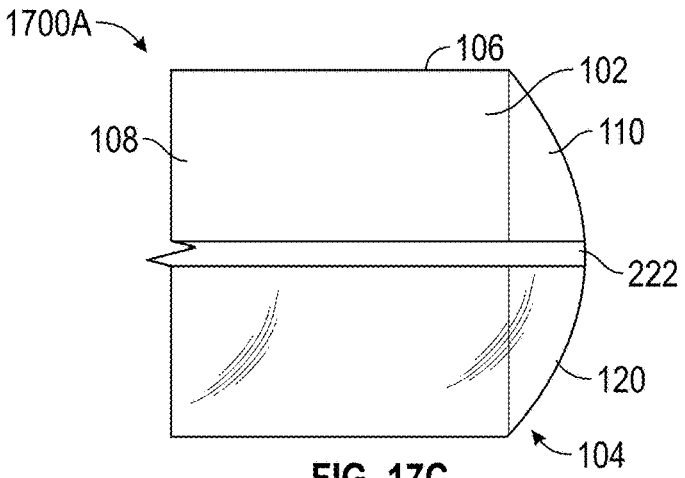
FIG. 17C is a partial side view of the luminaire of FIG. 17A.
Figure 17D:
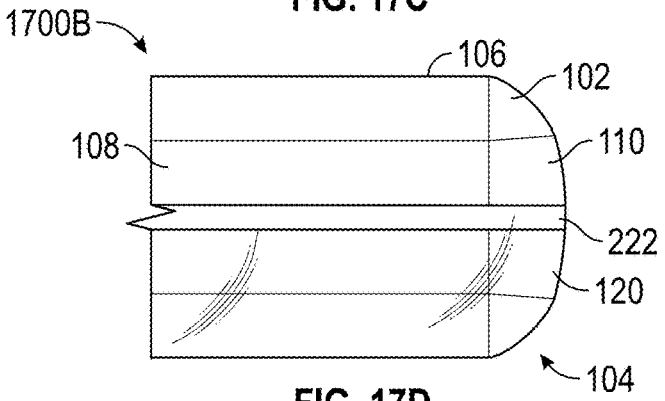
FIG. 17D is a partial side view of the luminaire of FIG. 17B.

FIGS. 17A,C,E illustrate an example of a luminaire 1700A and FIGS. 17B,D illustrate an example of a luminaire 1700B The luminaires 1700A,B are substantially similar to the luminaire 100 except that the luminaires 1700A,B have a trapezoidal shaped housing 102 and light engine 104, respectively. As illustrated in FIG. 17A, in some examples, the luminaire 1700A can include a mounting support 1776 that can be utilized to mount the luminaire 1700A to a wall, support, fixture, or various other structures.

Figure 17E:
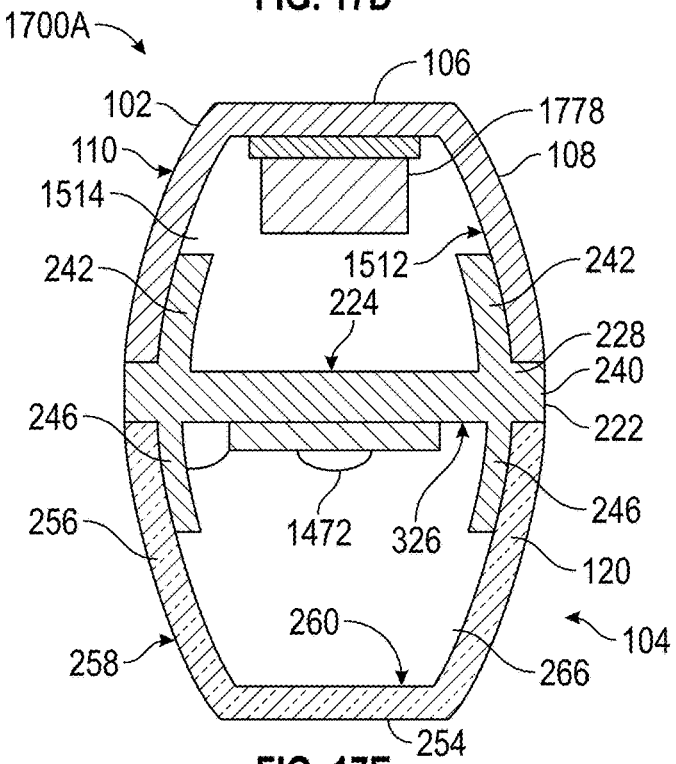
FIG. 17E is a sectional view of the luminaire of FIG. 17A.

As illustrated in FIG. 17E, an electrical component 1778 can be mounted within a housing cavity 1714. FIG. 17E also illustrates an example where the at least one upstanding flange 242 and the at least one downwardly extending flange 246 are positioned along the same portion of the mounting support 228. As illustrated in this example, in some embodiments, the at least one upstanding flange 242 can abut a portion of the housing 102 and the at least one downwardly extending flange 246 can abut a portion of the lens 120.

Figure 18A:
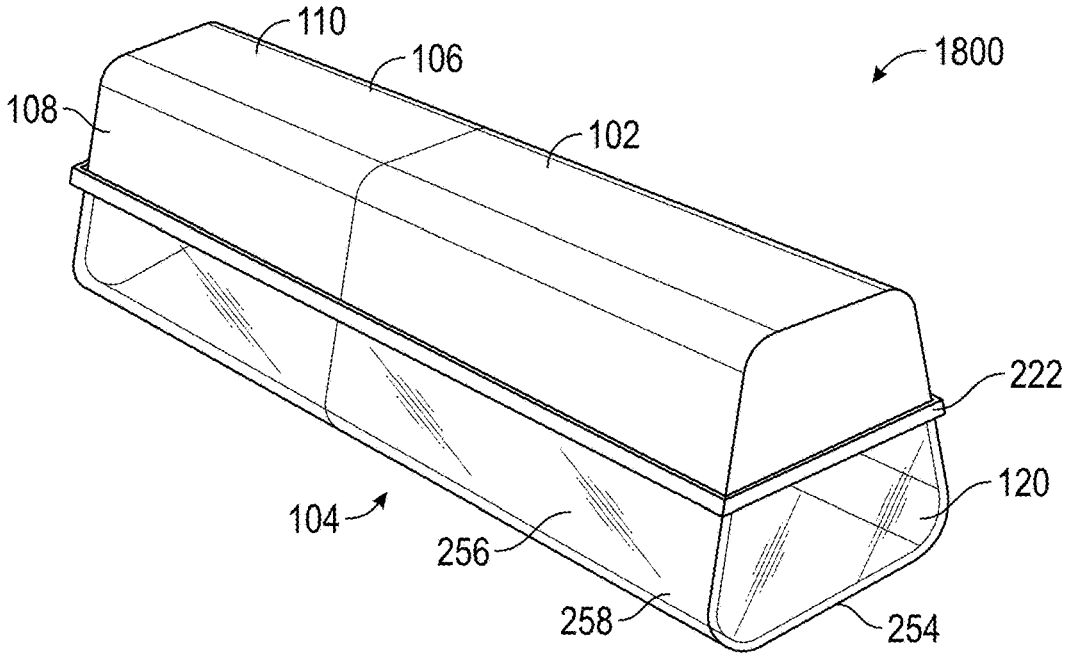
FIG. 18A is a perspective view of a luminaire according to an example of the current disclosure.
Figure 18B:
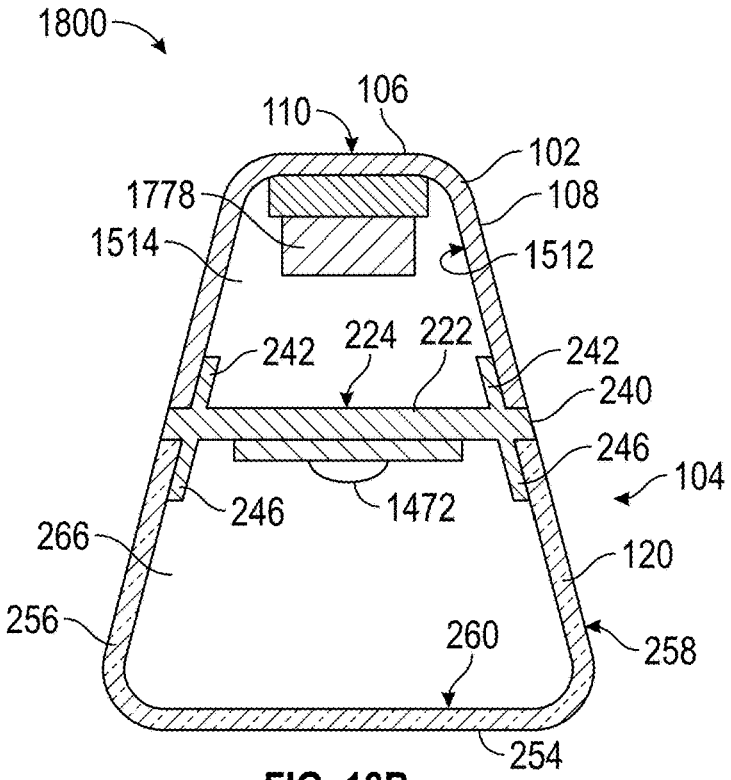
FIG. 18B is a sectional view of the luminaire of FIG. 18A.
Figure 19A:
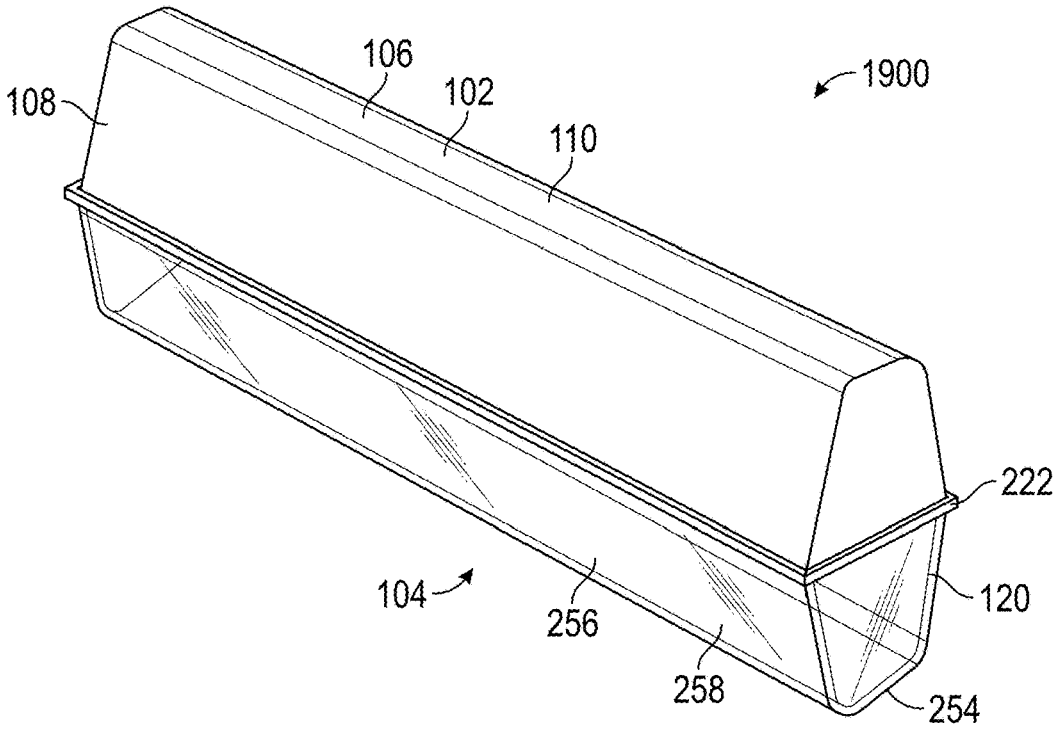
FIG. 19A is a perspective view of a luminaire according to an example of the current disclosure.
Figure 19B:
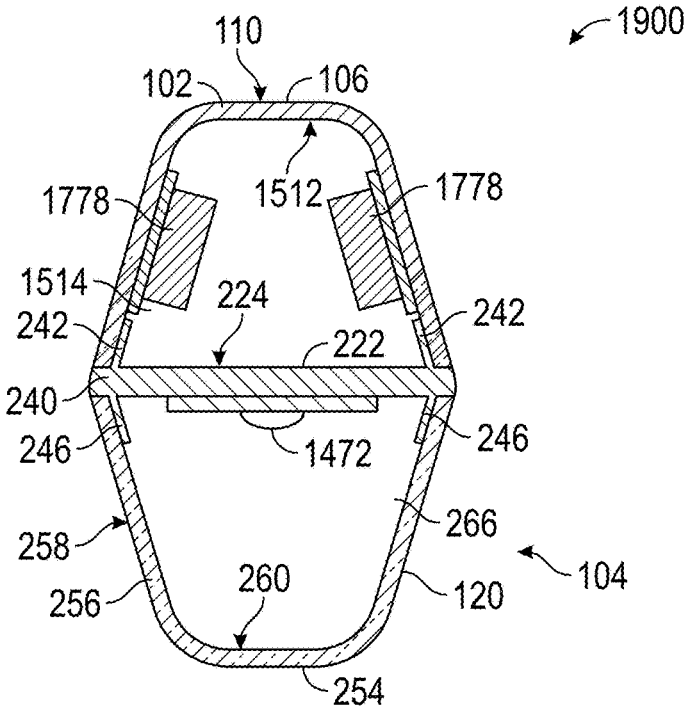
FIG. 19B is a sectional view of the luminaire of FIG. 19A.

FIGS. 18A-B illustrate an example of a luminaire 1800, which is substantially similar to the luminaire 100 except that the luminaire 1800 has a trapezoidal shape. FIGS. 19A-B illustrate an example of a luminaire 1900, which is substantially similar to the luminaire 100 except that the luminaire 1900 has a trapezoidal shaped housing 102 and light engine 104.

Figure 20A:
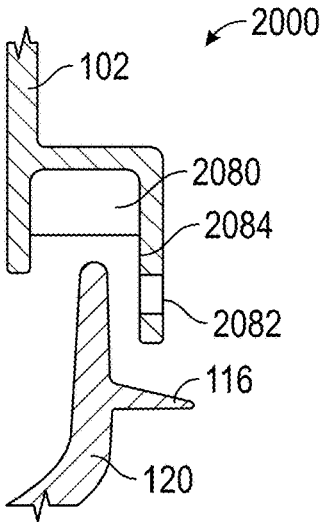
FIG. 20A illustrates a mounting mechanism for a lens and a housing of a luminaire according to examples of the current disclosure in a detached configuration.
Figure 20B:
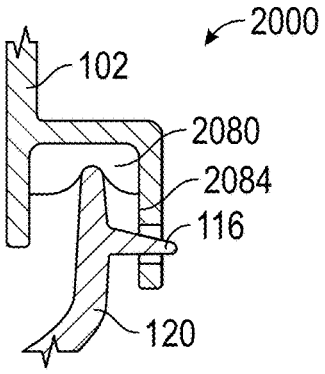
FIG. 20B illustrates the luminaire of FIG. 20A with the mounting mechanism in an attached configuration.

Referring to FIGS. 20A-B, in some examples, a gasket 2080 or other sealing device may be interposed between the lens 120 and the housing 102 to seal the inside of a luminaire 2000 from dust, water, and other contaminants that can detrimentally impact operation of the luminaire 2000. In various examples, the gasket 2080 is positioned within a gasket channel 2084 defined by the housing 102 or the light engine 104. FIGS. 20A-B also illustrate examples where the housing fasteners 116 are snaps defined by the lens 120, and which are configured to engage a slot 2082 defined by the housing 102.

Figure 20C:
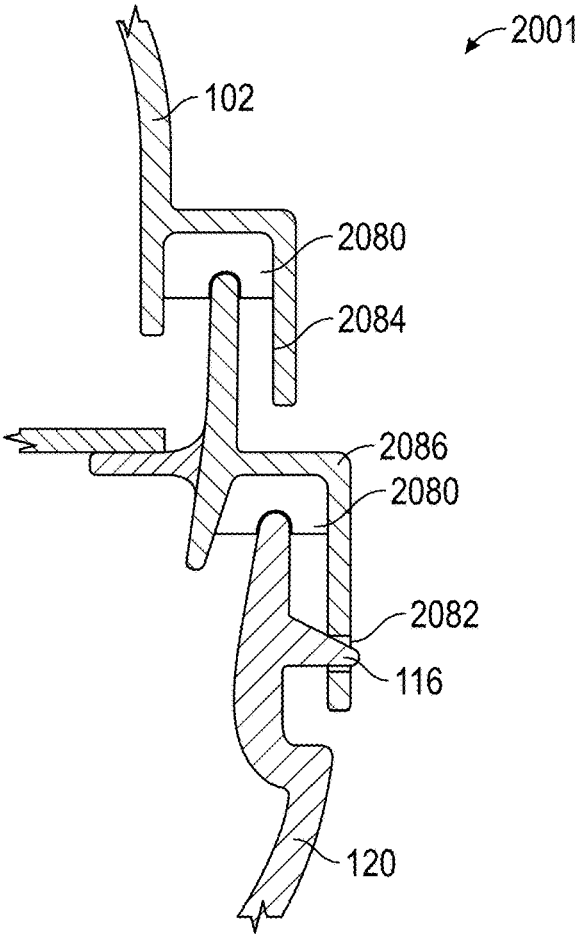
FIG. 20C illustrates a mounting mechanism for a lens, a mid-housing, and a housing of a luminaire according to examples of the current disclosure.

FIG. 20C further illustrates an example of a luminaire 2001 that includes a mid-housing 2086. In various examples, the light engine 104 can be attached to the housing 102 via the mid-housing 2086. In some examples, the mid-housing 2086 may attach to the housing 102 in a manner similar to that described previously with reference to the lens 120 and housing 102.

Figure 21A:
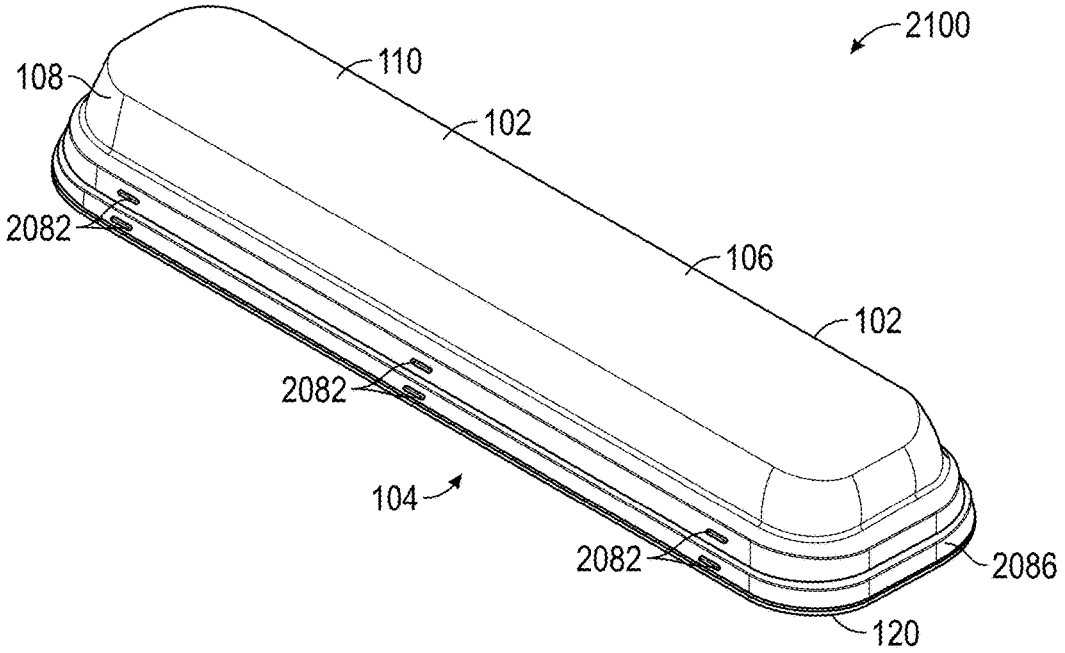
FIG. 21A is a perspective view of a luminaire according to an example of the current disclosure.
Figure 21B:
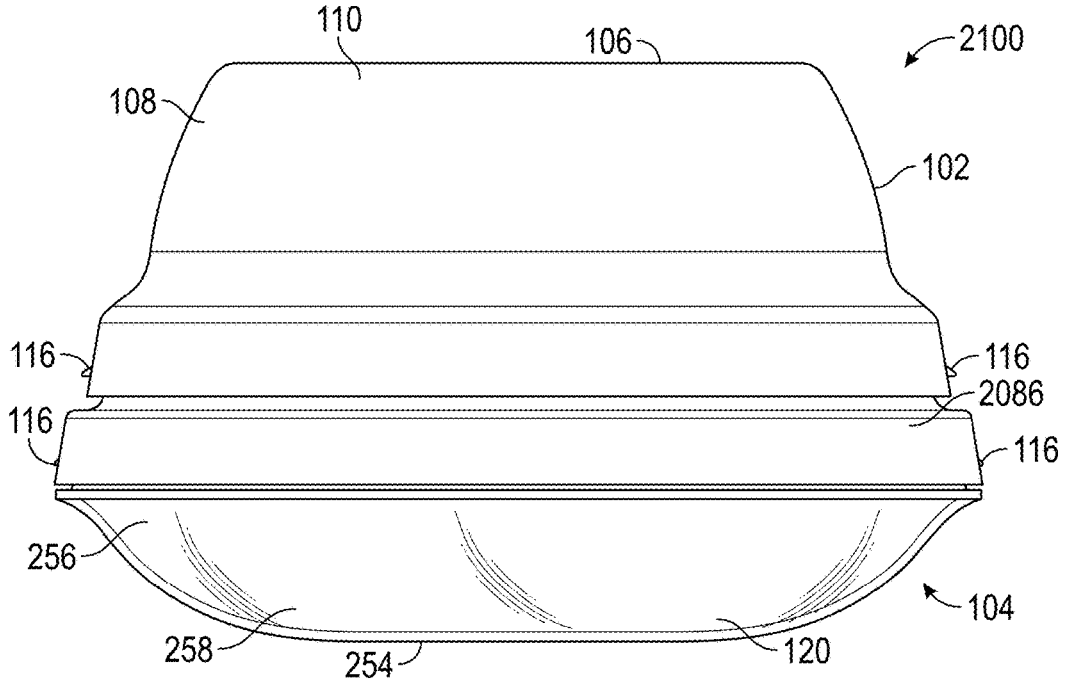
FIG. 21B is a front view of the luminaire of FIG. 21A.
Figure 21C:
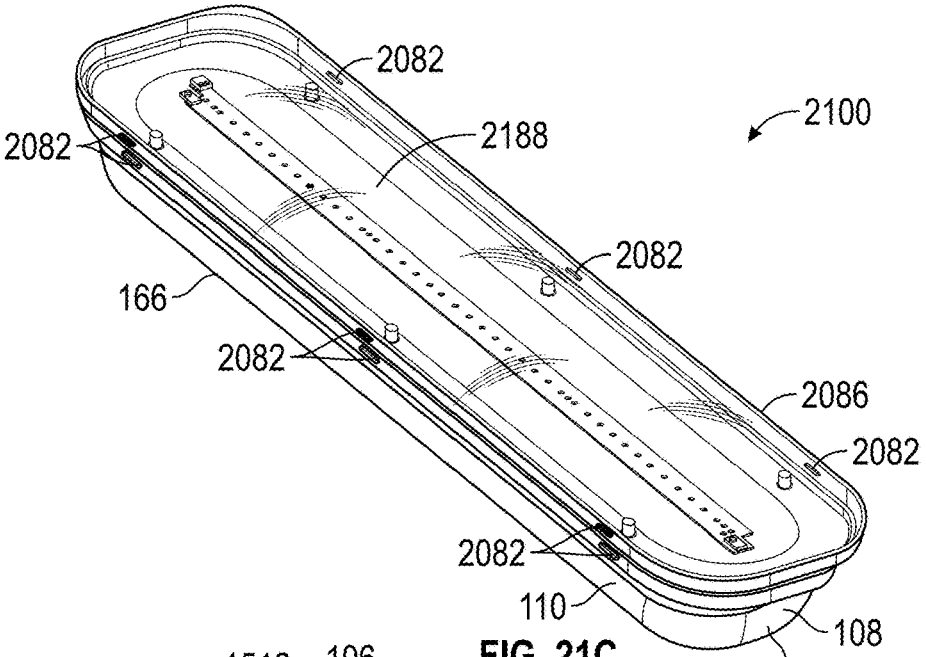
FIG. 21C is a perspective view of the light engine of FIG. 21A.
Figure 21D:
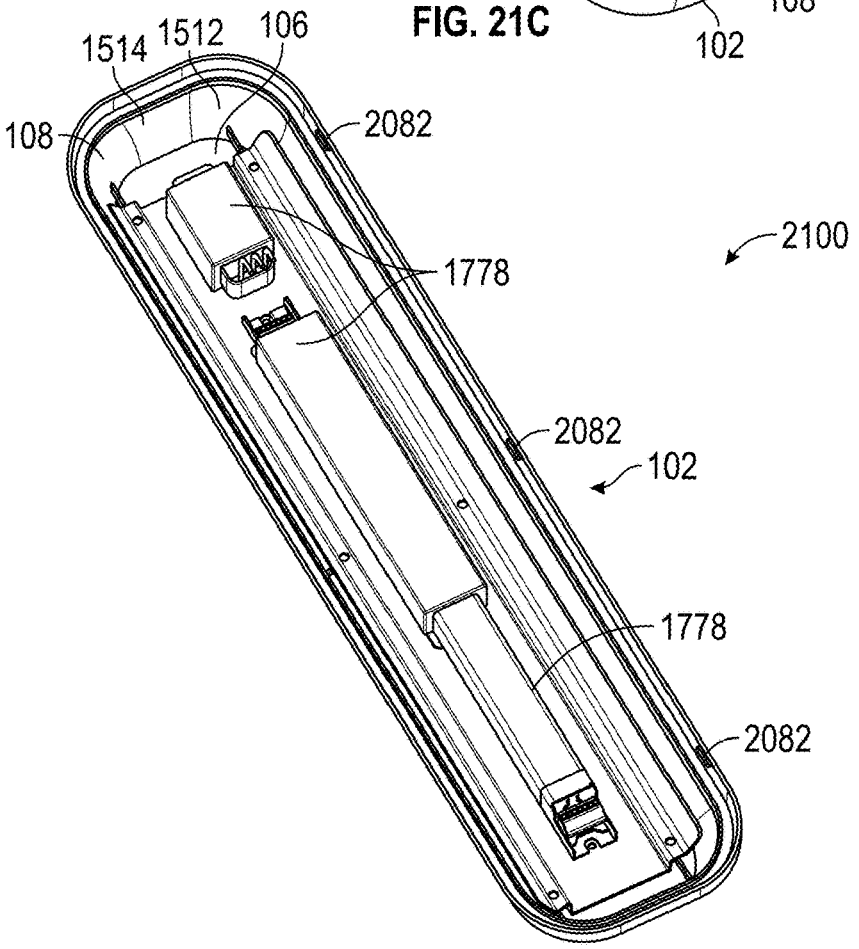
FIG. 21D is a perspective view of the housing of FIG. 21A.
Figure 21E:
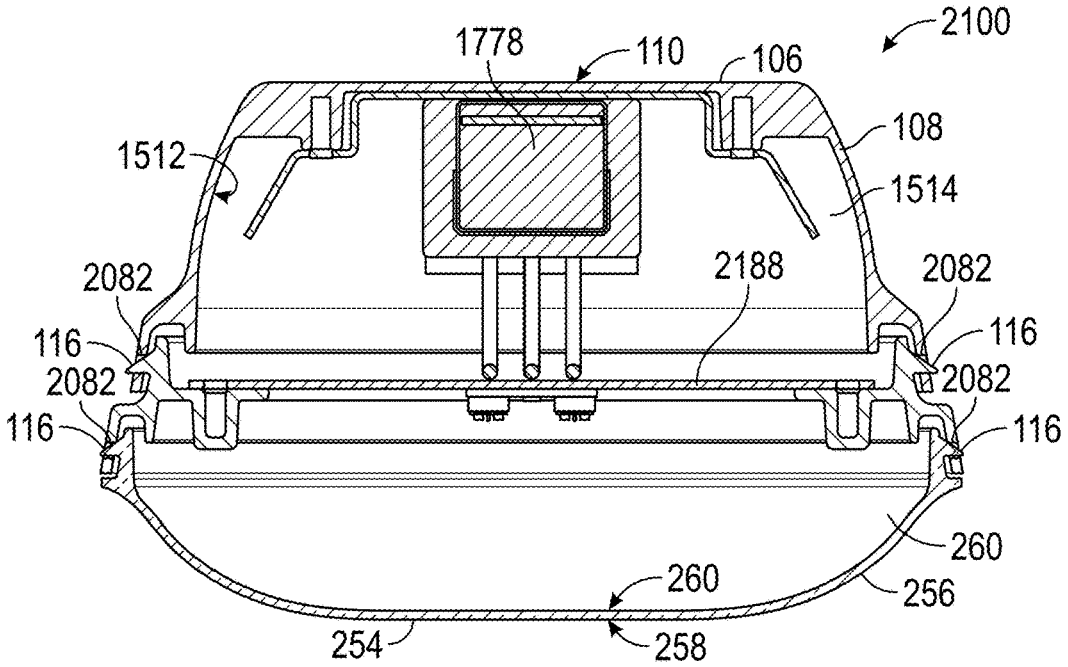
FIG. 21E is a sectional view of the housing of FIG. 21A.
Figure 22A:
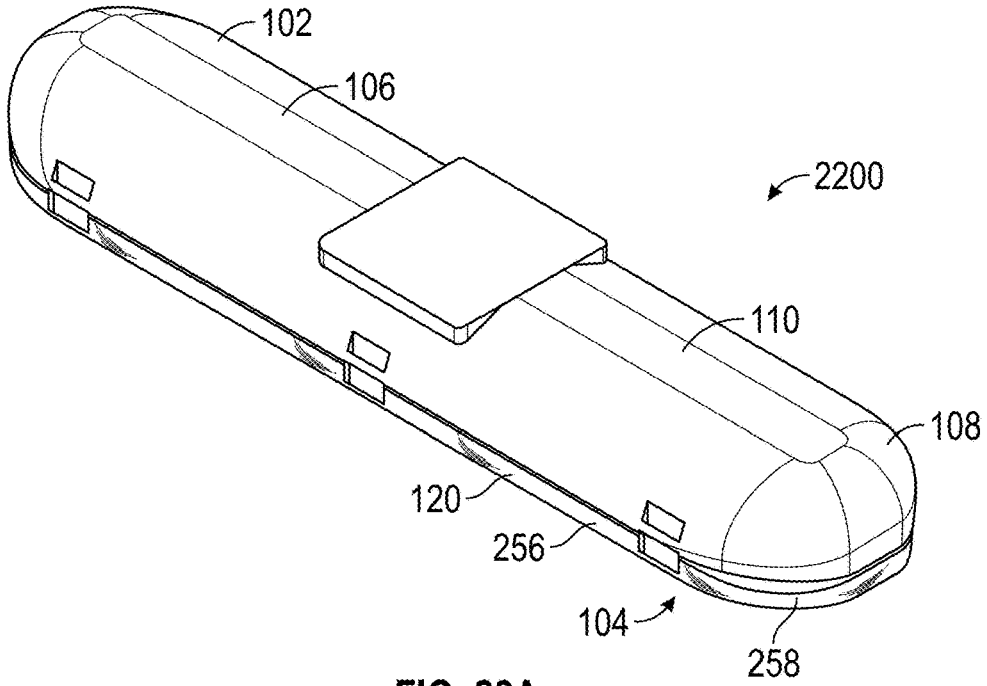
FIG. 22A is a perspective view of a luminaire according to an example of the current disclosure.
Figure 22B:
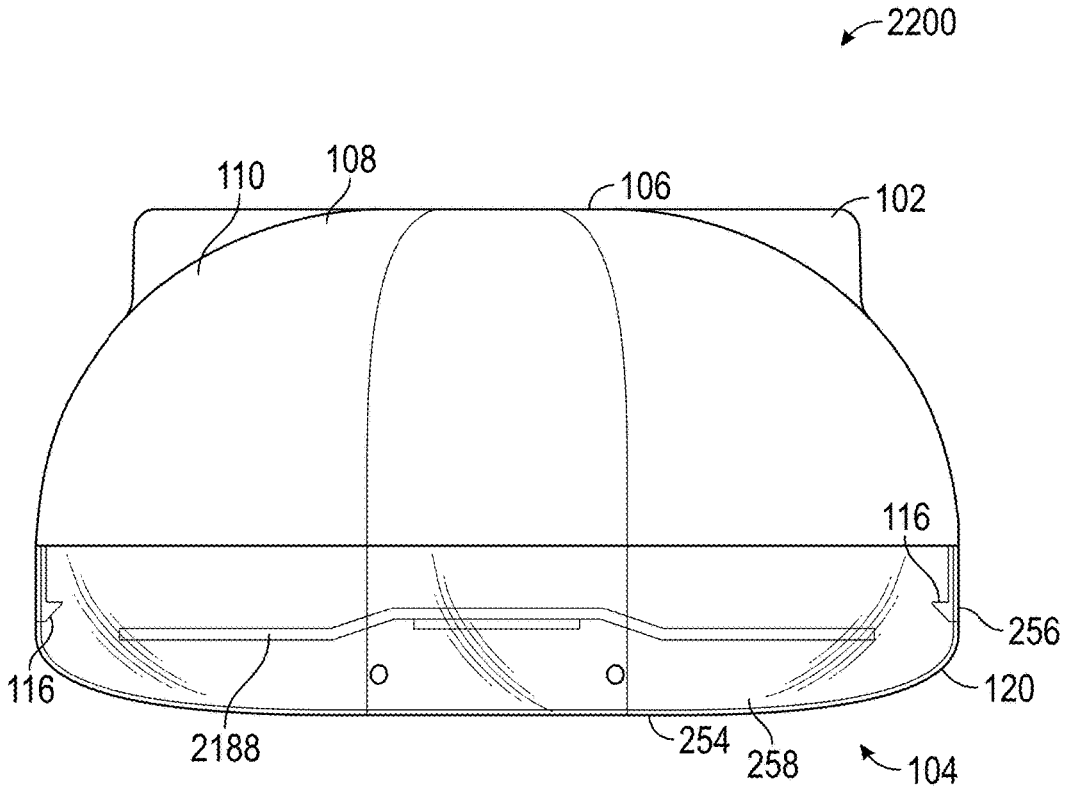
FIG. 22B is a front view of the luminaire of FIG. 22A.
Figure 22C:
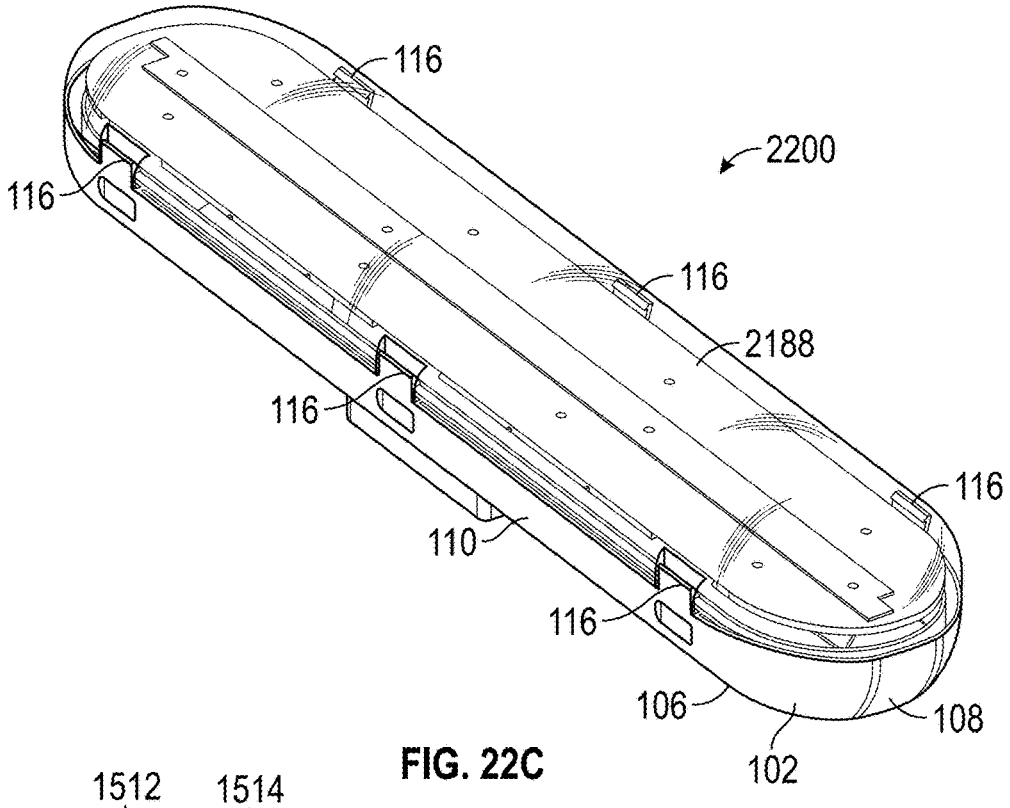
FIG. 22C is a perspective view of the light engine of FIG. 22A.
Figure 22D:
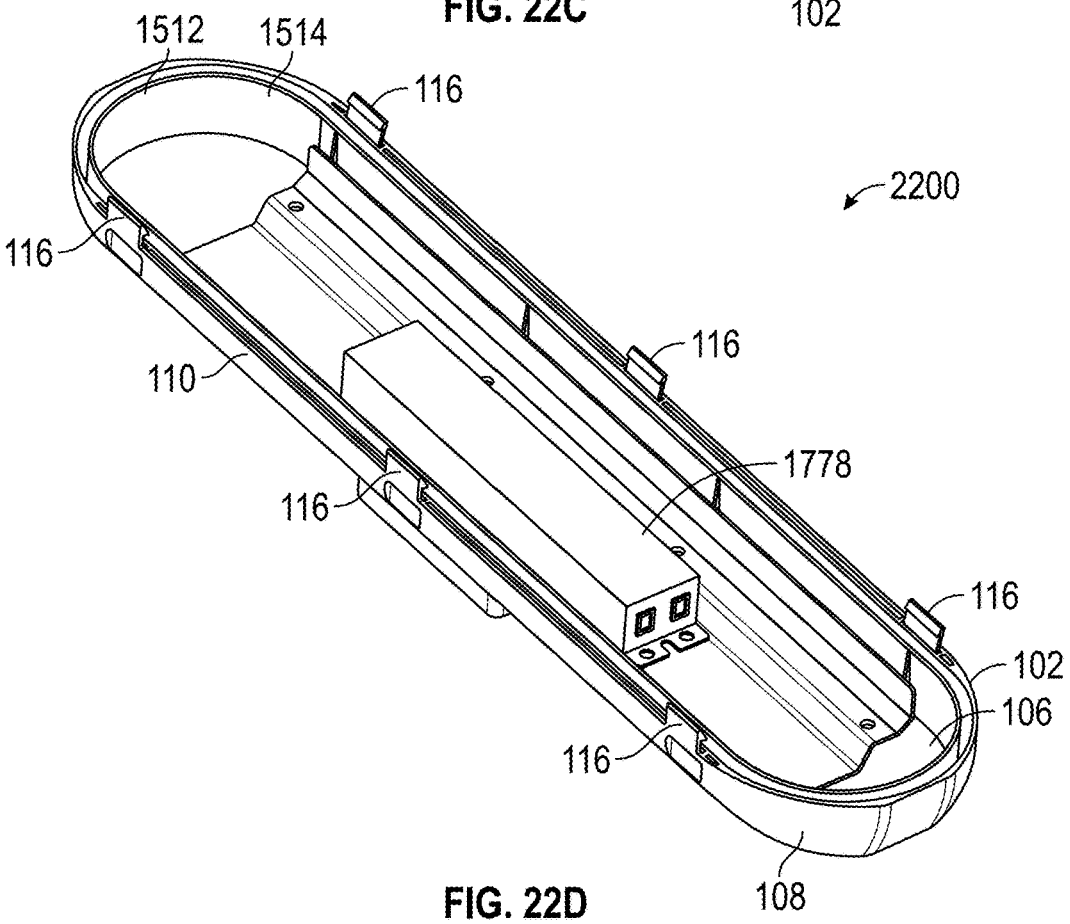
FIG. 22D is a perspective view of the housing of FIG. 22A.
Figure 22E:
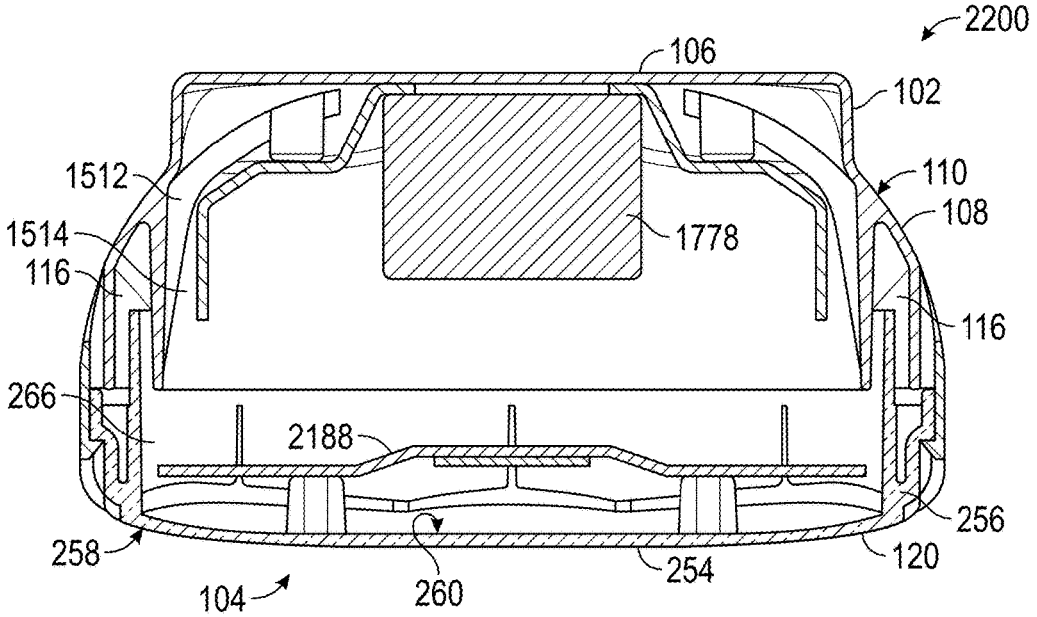
FIG. 22E is a sectional view of the housing of FIG. 22A.
Figure 23A:
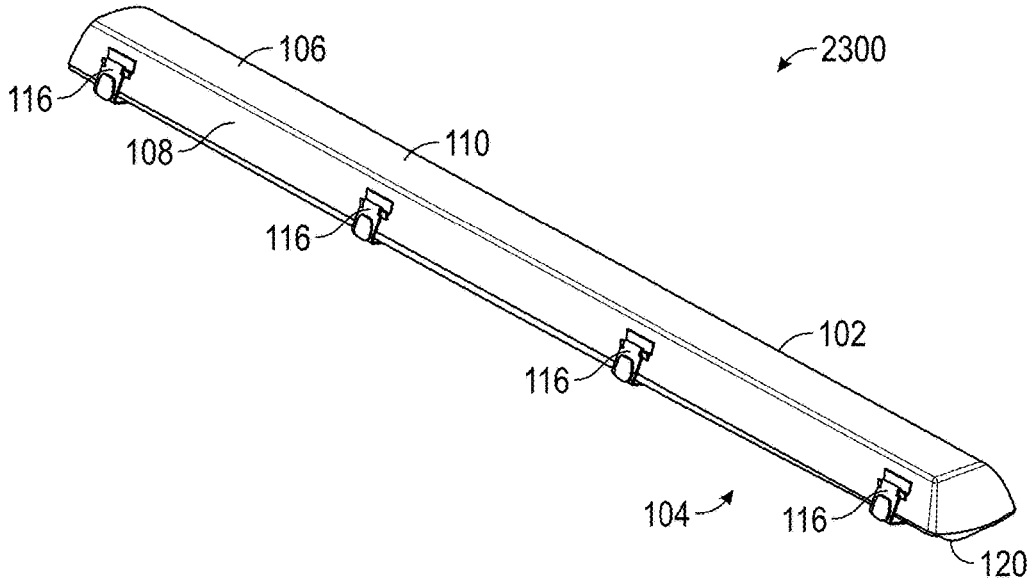
FIG. 23A is a perspective view of a luminaire according to an example of the current disclosure.
Figure 23B:
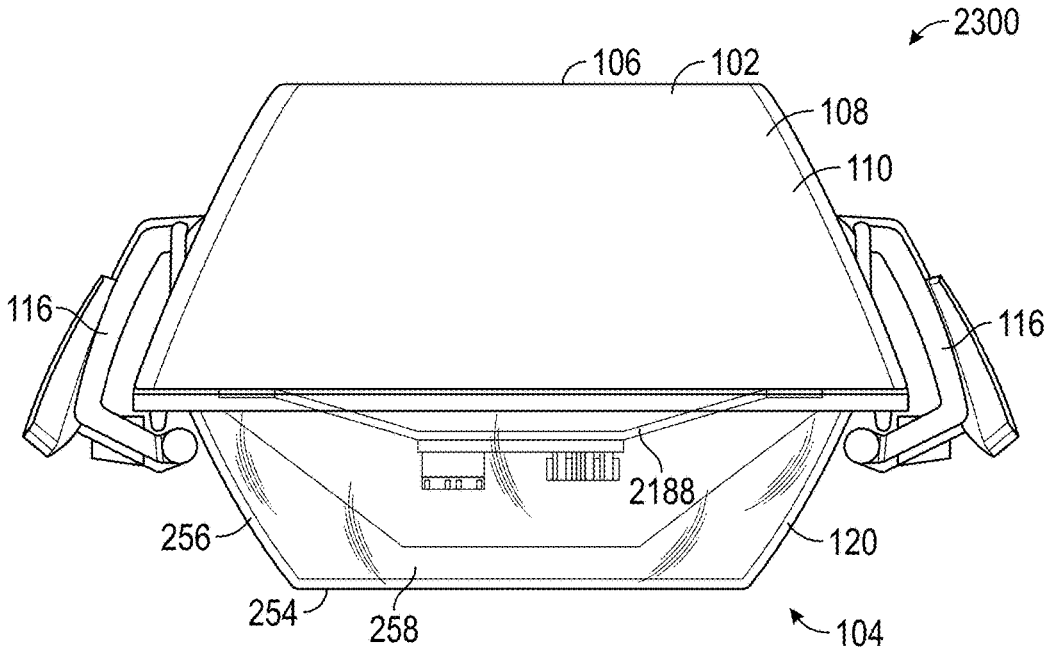
FIG. 23B is a front view of the luminaire of FIG. 23A.
Figure 23C:
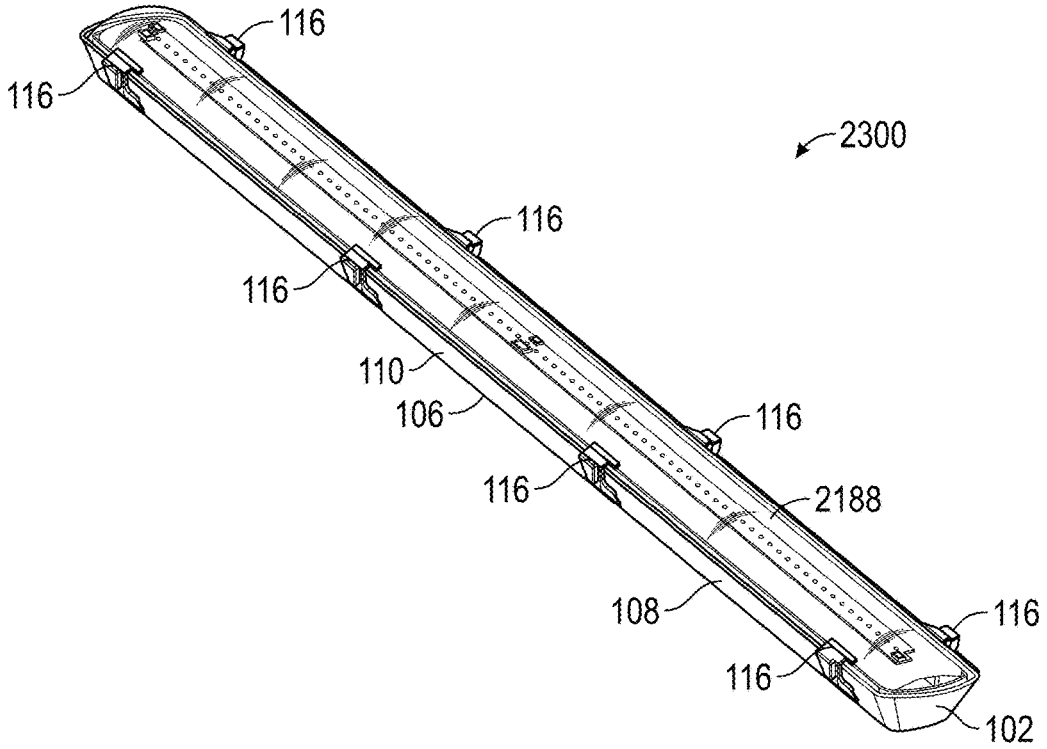
FIG. 23C is a perspective view of the light engine of FIG. 23A.
Figure 23D:
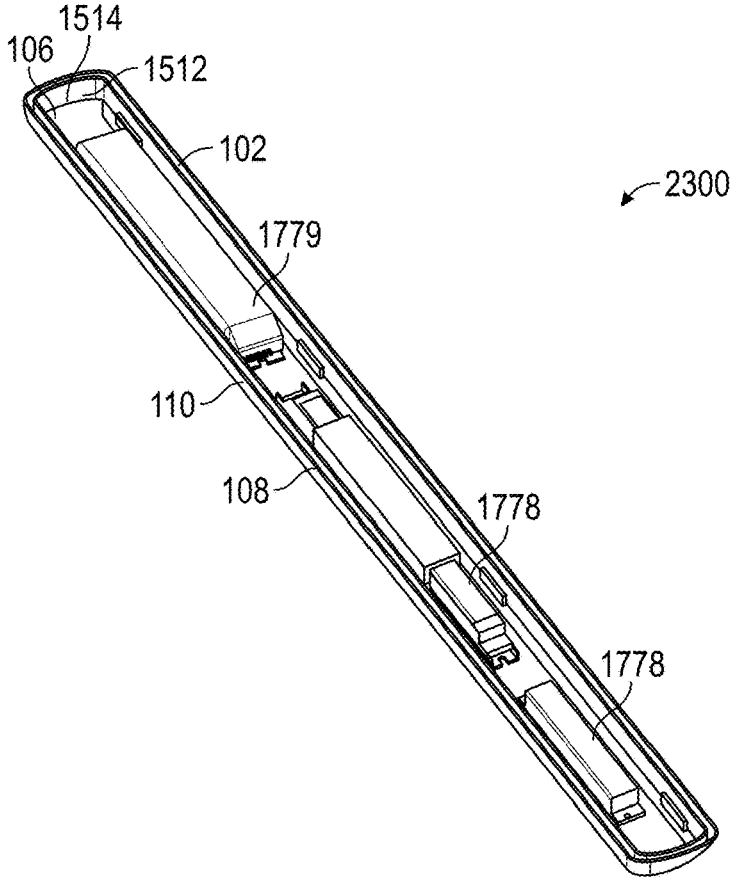
FIG. 23D is a perspective view of the housing of FIG. 23A.
Figure 23E:
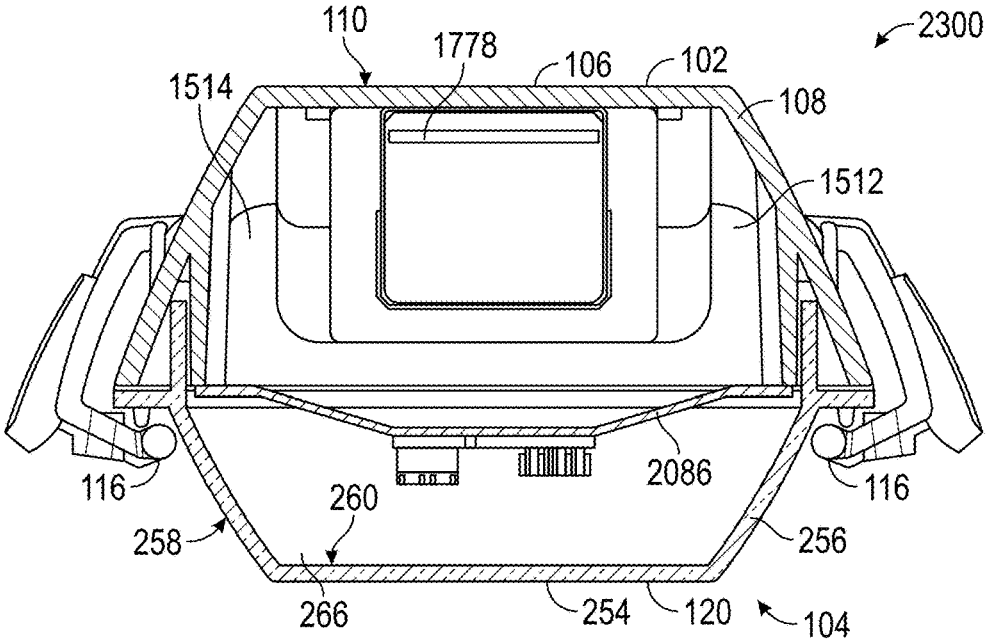
FIG. 23E is a sectional view of the housing of FIG. 23A.

FIGS. 21A-E illustrate an example of a luminaire 2100 that is substantially similar to the luminaire 100 except that the luminaire 2100 has a saucer-like shape. The luminaire 2100 also includes the mid-housing 2086. As illustrated in FIG. 21E, in some embodiments, the mid-housing 2086 supports a PCB 2188. In these figures, the housing fasteners 116 are snaps.

FIGS. 22A-E illustrate an example of a luminaire 2200 that is substantially similar to the luminaire 100 except that the luminaire 2200 has a tubular shape. In these figures, the housing fasteners 116 are snaps. FIGS. 23A-E illustrate an example of a luminaire 2300 that is substantially similar to the luminaire 100 except that the luminaire 2300 has a trapezoidal shape. In these figures, the housing fasteners 116 are latches.

Figure 24A:
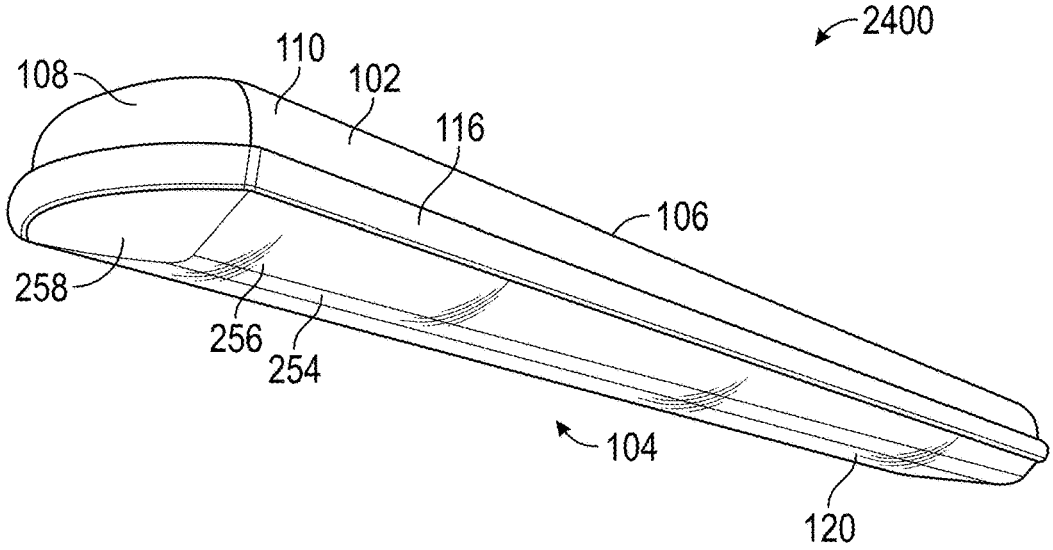
FIG. 24A is a perspective view of a luminaire having a housing and a pre-assembled light engine having an optical tray and lens according to an example of the current disclosure.
Figure 24B:
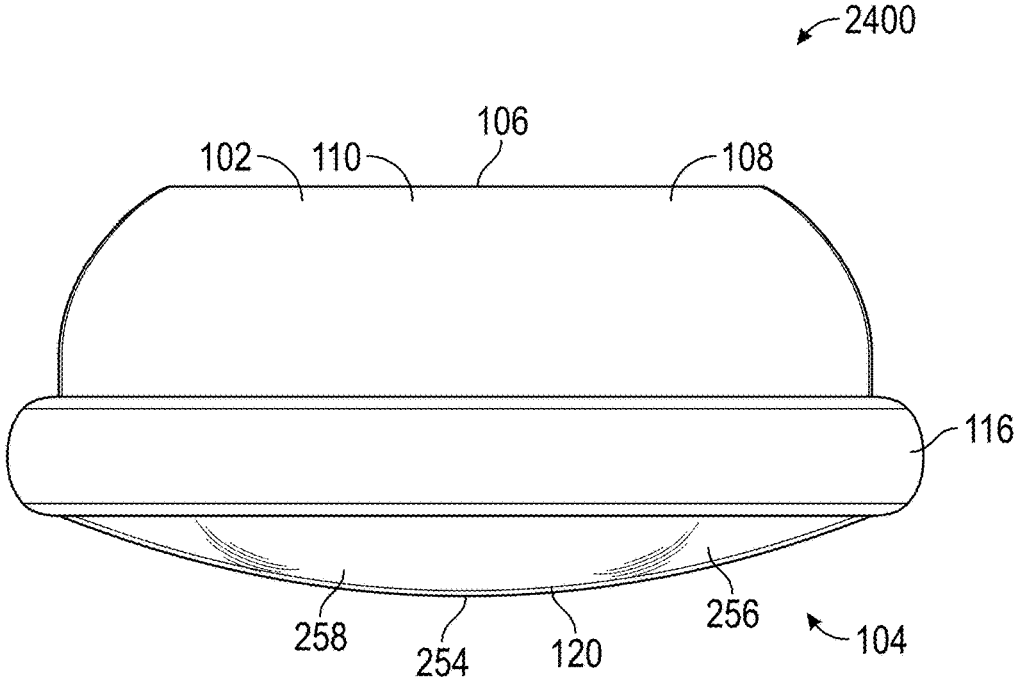
FIG. 24B is a front view of the luminaire of FIG. 24A.
Figure 24C:
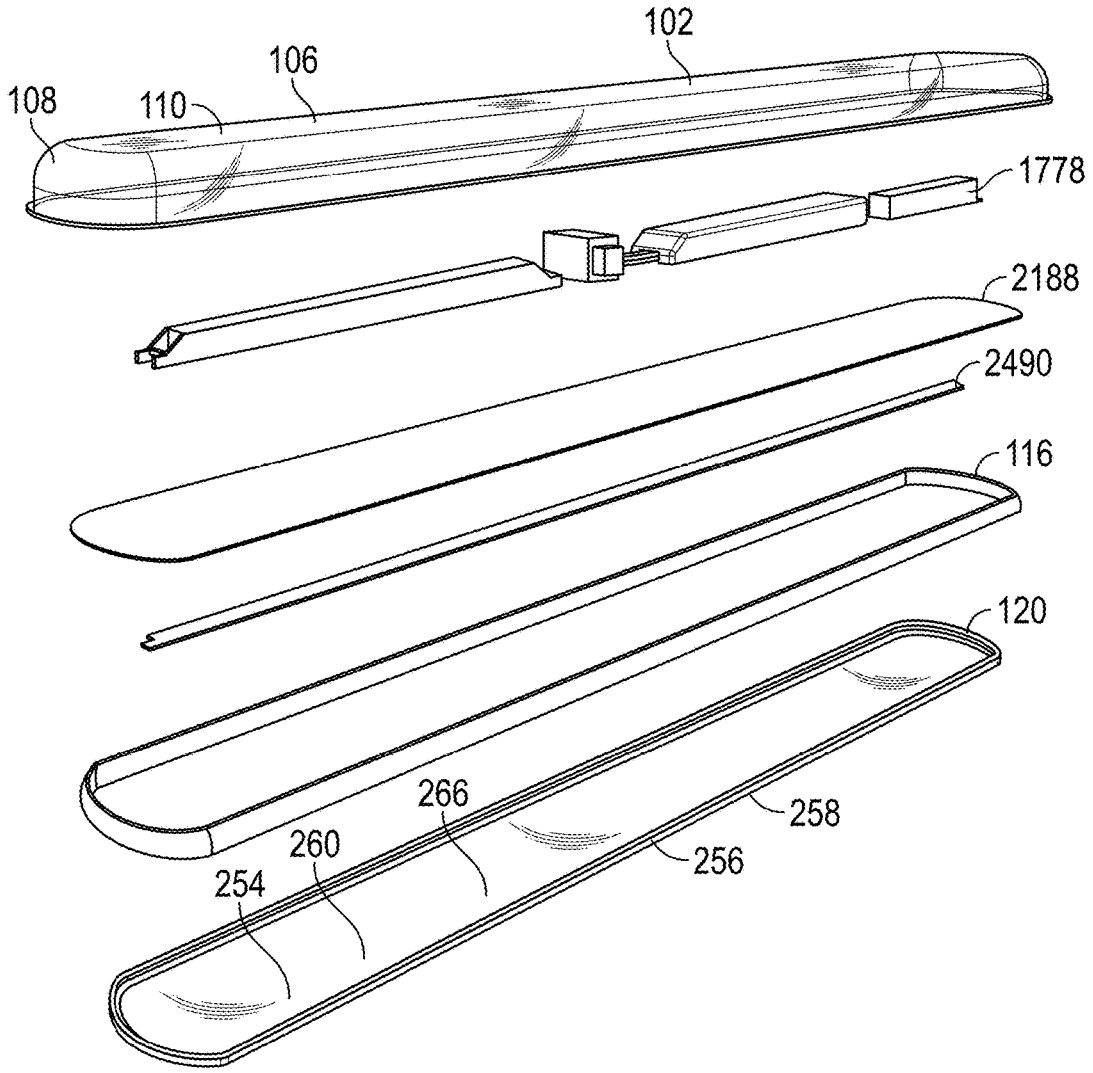
FIG. 24C is an exploded view of the luminaire of FIG. 24A.
Figure 24D:
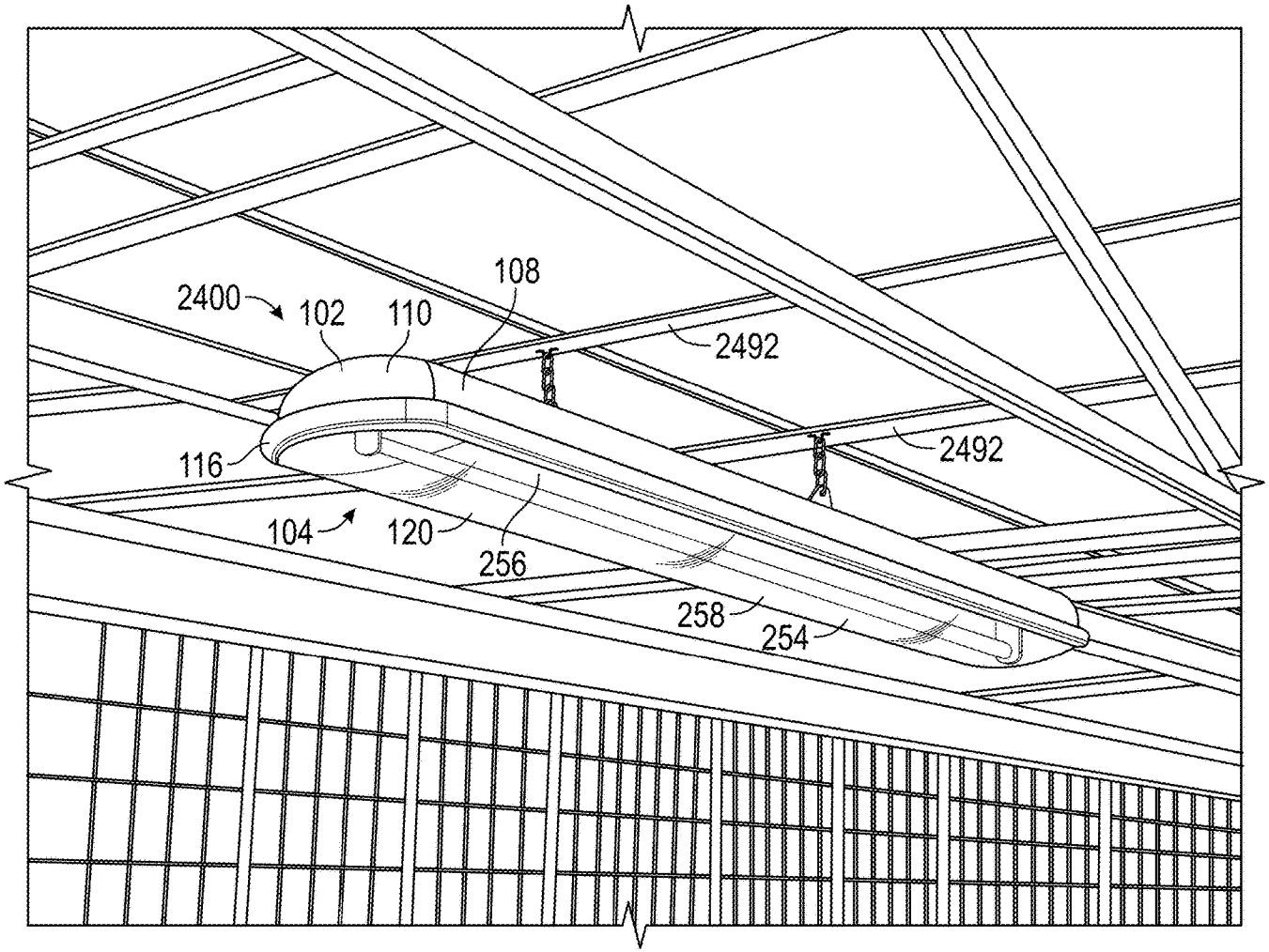
FIG. 24D is another perspective view of the luminaire of FIG. 24A.
Figure 25A:
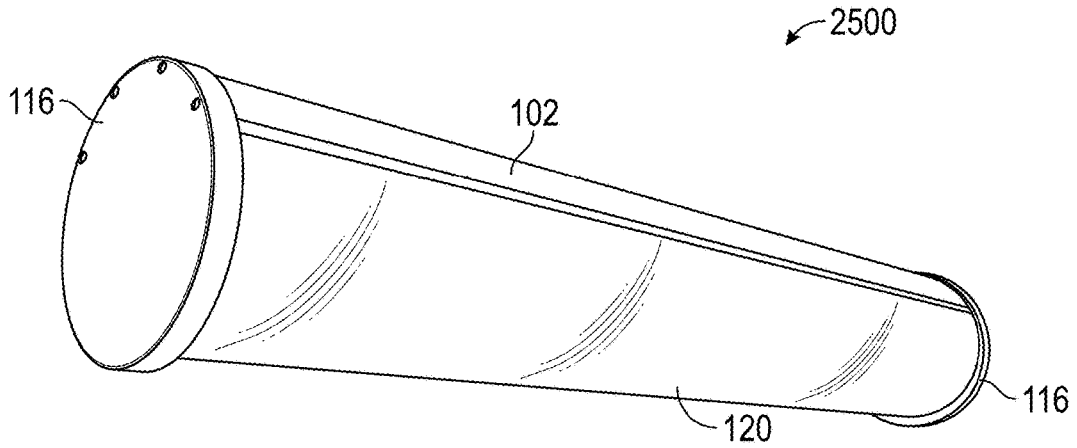
FIG. 25A is a perspective view of a luminaire according to an example of the current disclosure.
Figure 25B:
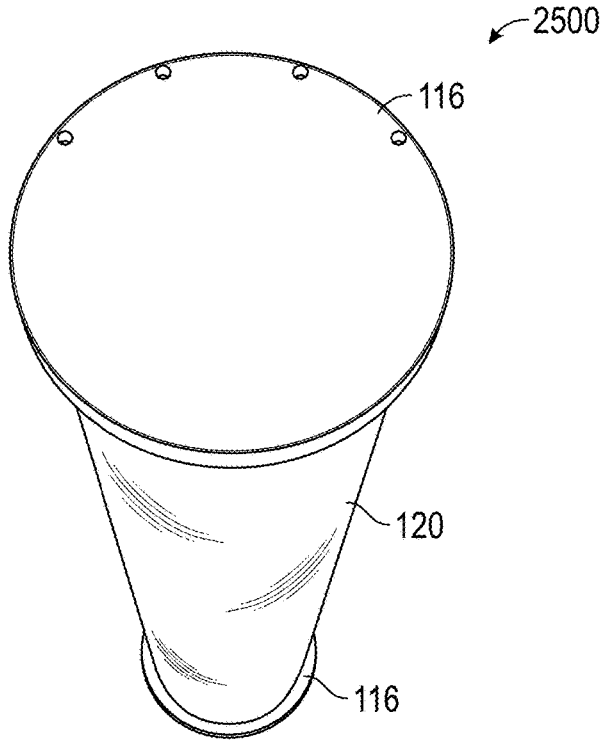
FIG. 25B is another perspective view of the luminaire of FIG. 25A.
Figure 25C:
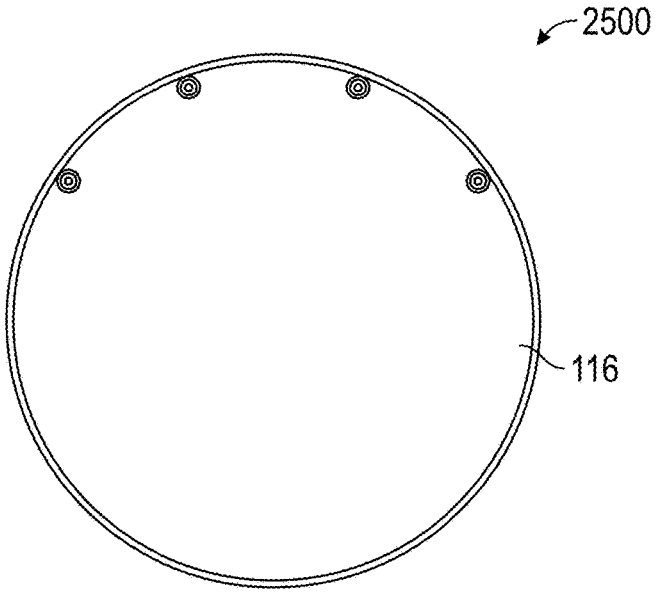
FIG. 25C is a front view of the luminaire of FIG. 25A.
Figure 25D:
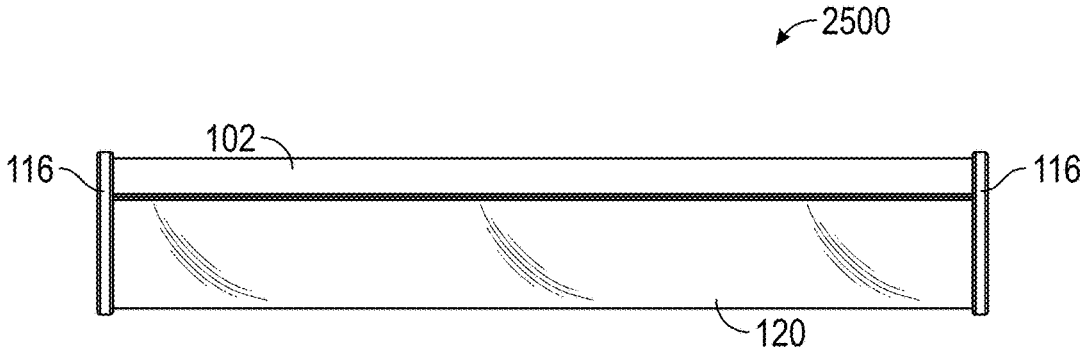
FIG. 25D is a side view of the luminaire of FIG. 25A.
Figure 26A:
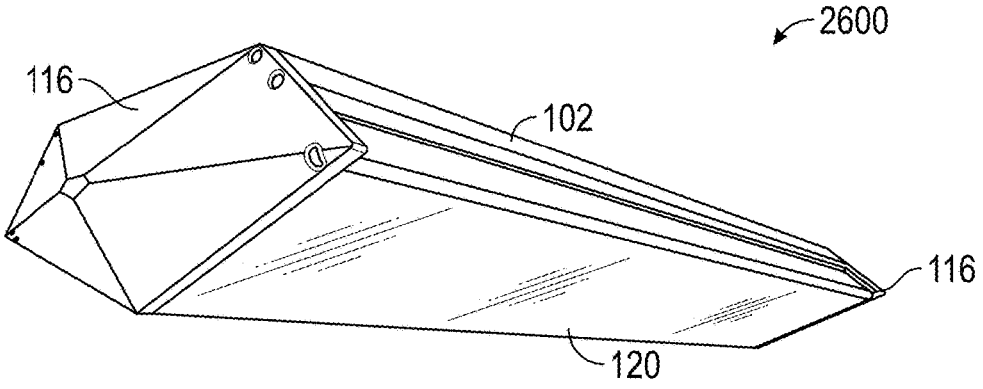
FIG. 26A is a perspective view of a luminaire according to an example of the current disclosure.
Figure 26B:
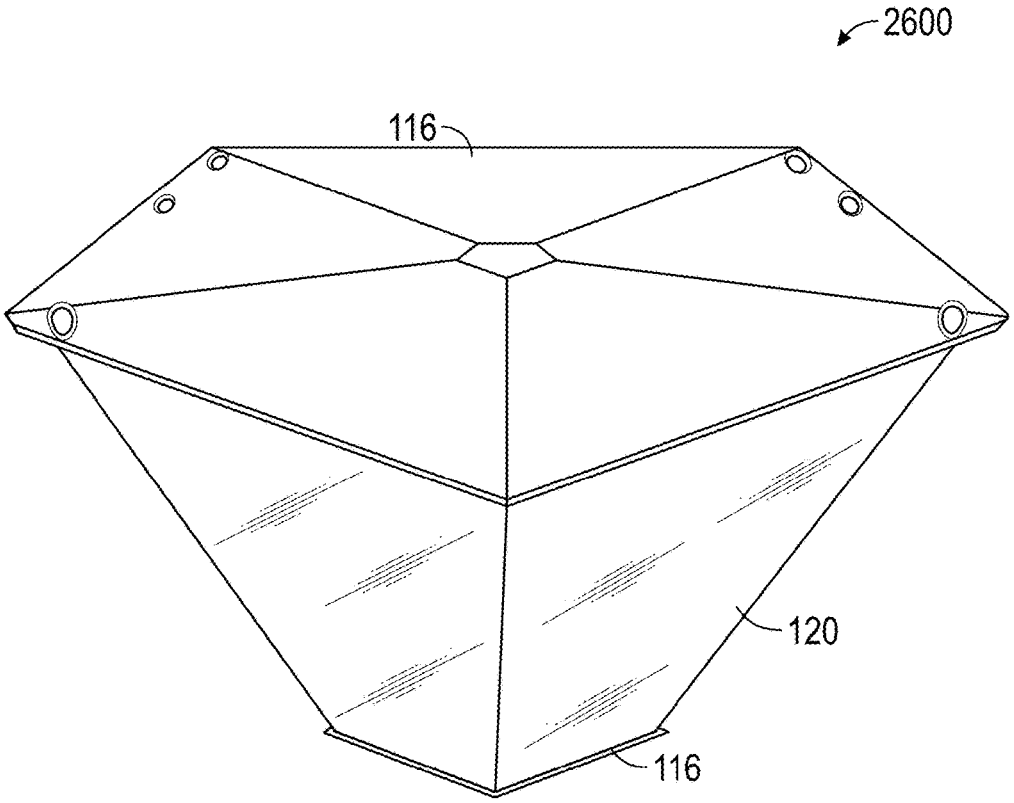
FIG. 26B is another perspective view of the luminaire of FIG. 26A.
Figure 26C:
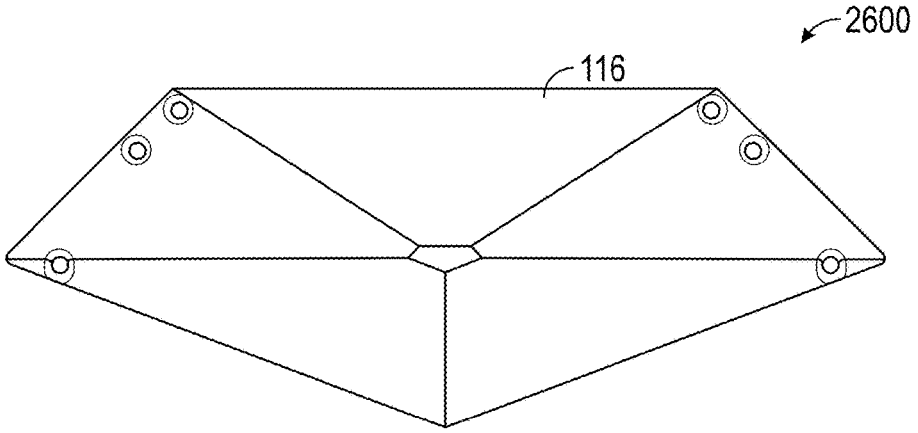
FIG. 26C is a front view of the luminaire of FIG. 26A.
Figure 26D:
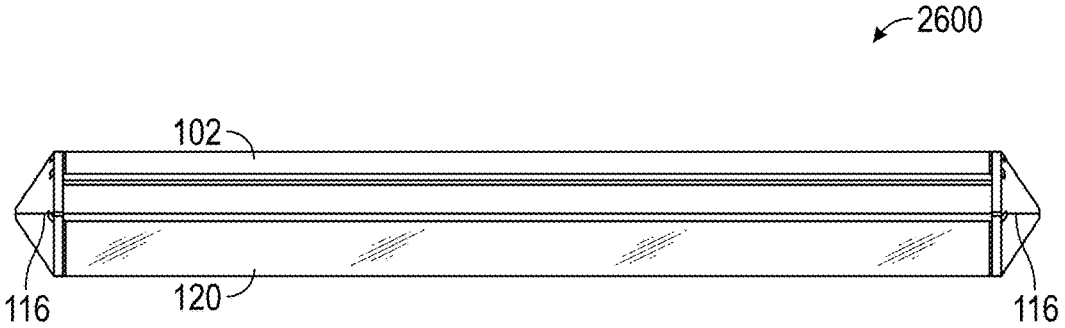
FIG. 26D is a side view of the luminaire of FIG. 26A.
Figure 26E:
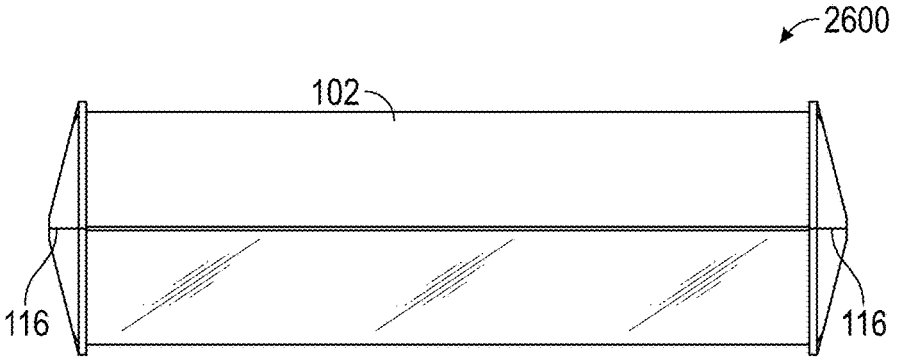
FIG. 26E is a top view of the luminaire of FIG. 26A.

FIGS. 24A-E illustrate an example of a luminaire 2400 that is substantially similar to the luminaire 100 except that the luminaire 2400 has a saucer-like shape. In these figures, the housing fastener 116 is a gasket band. As illustrated in FIG. 24C, in various embodiments, the luminaire 2400 includes a PCB 2490 to which LEDs or other electrical components can be attached. FIG. 24D illustrates the luminaire 2400 hanging from a support 2492.

FIGS. 25A-D illustrate an example of a luminaire 2500 that is substantially similar to the luminaire 100 except that the luminaire 2500 is tubular. As illustrated in these figures, in various embodiments, the housing fasteners 116 are end caps that are secured to the housing 102. FIGS. 26A-E illustrate an example of a luminaire 2600 that is substantially similar to the luminaire 100 except that the luminaire 2600 has a pentagonal shape and includes the end caps 2592.

The foregoing is provided for purposes of illustrating, explaining, and describing embodiments of the present invention. Further modifications and adaptations to these embodiments will be apparent to those skilled in the art and may be made without departing from the scope or spirit of the invention. Different arrangements of the components depicted in the drawings or described above, as well as components and steps not shown or described are possible. Similarly, some features and subcombinations are useful and may be employed without reference to other features and subcombinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the invention.

It should be emphasized that the above-described aspects are merely possible examples of implementations, merely set forth for a clear understanding of the principles of the present disclosure. Many variations and modifications can be made to the above-described embodiment(s) without departing substantially from the spirit and principles of the present disclosure. All such modifications and variations are intended to be included herein within the scope of the present disclosure, and all possible claims to individual aspects or combinations of elements or steps are intended to be supported by the present disclosure. Moreover, although specific terms are employed herein, as well as in the claims which follow, they are used only in a generic and descriptive sense, and not for the purposes of limiting the described invention, nor the claims which follow.

That which is claimed is:

1. A luminaire comprising:

a housing; and a light engine detachably secured to the housing, the light engine comprising:

a lens having an outer surface and an inner surface separated by a peripheral edge, the inner surface defining a lens cavity, and an optical tray comprising a base comprising a mounting surface, a perimeter edge, and at least one light source provided on the mounting surface, wherein the optical tray further comprises an upstanding flange along a first portion of the perimeter edge and a downwardly extending flange along a second portion of the perimeter edge, wherein the upstanding flange extends in an upward direction relative to the base and the downwardly extending flange extends in a downward direction relative to the base, and wherein the optical tray is supported by the lens within the lens cavity such that the base and the at least one light source are within the lens cavity and recessed relative to the peripheral edge.

2. The luminaire of claim 1, wherein the at least one light source comprises LEDs, and wherein the LEDs are provided on the mounting surface of the optical tray.

3. The luminaire of claim 1, wherein the mounting surface of the base of the optical tray is a bottom surface of the base, and wherein the base of the optical tray further comprises a top surface, wherein the the upstanding flange extends in the upward direction relative to the top surface of the base.

4. The luminaire of claim 3, wherein the upstanding flange comprises at least one slot and wherein the housing comprising at least one fastener that engages the at least one slot.

5. The luminaire of claim 3, wherein the upstanding flange is a first upstanding flange, wherein the optical tray further comprises a second upstanding flange along a third portion of the perimeter edge, and wherein the second upstanding flange extends in the upward direction relative to the top surface of the base.

6. The luminaire of claim 5, wherein the second portion of the perimeter edge of the base comprising the downwardly extending flange is between the first upstanding flange and the second upstanding flange.

7. The luminaire of claim 6, wherein the downwardly extending flange comprises a lip defining a notch, wherein the inner surface of the lens defines a ledge having a ledge surface and a tab, and wherein the optical tray is positioned within the lens cavity such that the tab is engaged with the notch.

8. The luminaire of claim 7, wherein the lip is positioned on the ledge surface.

9. The luminaire of claim 1, wherein the inner surface of the lens defines a ledge having a ledge surface within the lens cavity, and wherein at least a portion of the optical tray rests on the ledge surface such that the optical tray is supported by the ledge.

10. The luminaire of claim 9, further comprising an adhesive interposed between at least a portion of the ledge surface and the at least portion of the optical tray to secure the lens and optical tray together.

11. The luminaire of claim 1, wherein the housing comprises:

an inner surface; and an outer surface, wherein the inner surface defines a housing cavity, and wherein the light engine is positioned at least partially within the housing cavity.

12. The luminaire of claim 11, further comprising a gasket positioned between the light engine and the housing.

13. A light engine comprising:

a lens having an outer surface, an inner surface, and a peripheral edge extending around a perimeter of the lens and separating the outer surface and the inner surface, wherein the inner surface of the lens defines a lens cavity, wherein the inner surface defines a ledge within the lens cavity that is recessed relative to the peripheral edge, and wherein the peripheral edge defines an opening providing access to the lens cavity; and an optical tray comprising a base, wherein the base comprises a mounting surface for at least one light surface and a perimeter edge, wherein the optical tray further comprises an upstanding flange along a first portion of the perimeter edge and a downwardly extending flange along a second portion of the perimeter edge, wherein the upstanding flange extends in an upward direction relative to the base and the downwardly extending flange extends in a downward direction relative to the base, and wherein the optical tray is positioned at least partially on the ledge of the lens within the lens cavity such that the mounting surface is within the lens cavity.

14. The light engine of claim 13, wherein the mounting surface is a bottom surface of the base of the optical tray, wherein the downwardly extending flange extends in a downward direction relative to the bottom surface of the base and comprises a lip, and wherein the lip is positioned on the ledge of the lens.

15. The light engine of claim 14, wherein a notch is provided in the lip and a rib is provided on the lens and wherein the rib engages the notch when the lip is positioned on the ledge of the lens.

16. The light engine of claim 13, further comprising an adhesive interposed between at least a portion of the ledge and a portion of the optical tray to secure the lens and optical tray together.

17. A method of assembling a luminaire comprising:

pre-assembling a light engine by securing an optical tray to a lens such that the optical tray is supported by the lens, wherein a base of the optical tray comprising a mounting surface for at least one light source is within a lens cavity, wherein at least one light source of the optical tray is mounted on the mounting surface and within the lens cavity, wherein the optical tray further comprises an upstanding flange along a first portion of a perimeter edge of the base and a downwardly extending flange along a second portion of the perimeter edge, wherein the upstanding flange extends in an upward direction relative to the base and the downwardly extending flange extends in a downward direction relative to the base; and detachably securing the light engine to a housing by engagement between the lens and the housing.

18. The method of claim 17, wherein securing the optical tray to the lens comprises at least partially positioning at least a portion of a flange extending from the optical tray on a ledge defined within the lens cavity.

19. The method of claim 17, wherein detachably securing the light engine to the housing comprises:

at least partially positioning the light engine within a housing cavity defined by the housing; and detachably engaging first fasteners positioned within the housing cavity with a slot defined in a side flange of the optical tray.

20. The method of claim 19, wherein detachably securing the light engine to the housing further comprises securing second fasteners located on one of the housing or the lens with recesses located on the other of the housing or the lens, wherein the second fasteners are positioned on an exterior of the luminaire.

* * * * *